US008950963B2

(12) United States Patent
Pechko et al.

(10) Patent No.: US 8,950,963 B2
(45) Date of Patent: Feb. 10, 2015

(54) MULTI-UNIT COSMETIC APPLICATOR

(71) Applicant: Avon Products, Inc., Suffern, NY (US)

(72) Inventors: Andrew H. Pechko, Ridgewood, NJ (US); John S. Kurek, Goshen, NY (US); Kristopher Porter, Union Beach, NJ (US)

(73) Assignee: Avon Products, Inc, New York, NY (US)

( * ) Notice: Subject to any disclaimer, the term of this patent is extended or adjusted under 35 U.S.C. 154(b) by 0 days.

(21) Appl. No.: 14/064,514

(22) Filed: Oct. 28, 2013

(65) Prior Publication Data

US 2014/0048092 A1 Feb. 20, 2014

Related U.S. Application Data

(60) Division of application No. 12/169,933, filed on Jul. 9, 2008, which is a continuation-in-part of application No. 11/818,027, filed on Jun. 13, 2007, now Pat. No. 8,579,529.

(60) Provisional application No. 60/900,369, filed on Feb. 8, 2007.

(51) Int. Cl.

| | |
|---|---|
| ***B43K 27/00*** | (2006.01) |
| ***A45D 40/26*** | (2006.01) |
| ***A45D 34/04*** | (2006.01) |
| ***A45D 40/02*** | (2006.01) |
| ***A45D 40/10*** | (2006.01) |
| ***A45D 40/24*** | (2006.01) |

(52) U.S. Cl.

CPC ..... *A45D 40/26* (2013.01); *A45D 34/04* (2013.01); *A45D 40/02* (2013.01); *A45D 40/10* (2013.01); *A45D 40/24* (2013.01); *A45D 2200/055* (2013.01)

USPC ..... 401/31; 401/29

(58) Field of Classification Search

USPC ..... 401/17, 29–34, 152, 164, 171, 172, 401/174, 35, 110, 111

See application file for complete search history.

(56) References Cited

U.S. PATENT DOCUMENTS

| | | | | |
|---|---|---|---|---|
| 1,623,059 | A | 4/1923 | Lammine | |
| 2,142,312 | A * | 1/1939 | Heinz | 401/56 |
| 2,491,980 | A | 12/1949 | Hines | |
| 2,591,027 | A | 4/1952 | Turnes | |
| 2,653,339 | A | 9/1953 | Mureau | |
| 2,710,614 | A | 6/1955 | Dulberg | |

(Continued)

FOREIGN PATENT DOCUMENTS

| | | | |
|---|---|---|---|
| DE | 20209902 | U | 10/2002 |
| EP | 0443819 | A2 | 8/1991 |

(Continued)

*Primary Examiner* — David Walczak
*Assistant Examiner* — Jennifer C Chiang
(74) *Attorney, Agent, or Firm* — David M. Joyal; Joan M. McGillycuddy

(57) ABSTRACT

The invention relates generally to a multi-unit cosmetic applicator comprising a housing body, a first cosmetic unit housed in the housing body, a second cosmetic unit housed in the housing body, an opening in the housing, wherein each cosmetic unit has a means for being independently movable relative to each other from a stored position to an advanced position and back to its stored position. The means may include a ratchet assembly, a squeeze assembly, or a dual twist assembly.

6 Claims, 16 Drawing Sheets

(56) References Cited

U.S. PATENT DOCUMENTS

| | | | | |
|---|---|---|---|---|
| 2,766,876 | A * | 10/1956 | Hopgood | 401/30 |
| 3,320,962 | A | 5/1967 | Moriber et al. | |
| 3,802,444 | A * | 4/1974 | Pensabene | 132/318 |
| 4,291,018 | A | 9/1981 | Oeda et al. | |
| 4,740,097 | A | 4/1988 | Kapustin | |
| 5,026,189 | A | 6/1991 | Keil | |
| 5,109,877 | A | 5/1992 | Takeda | |
| 5,111,972 | A | 5/1992 | Sakurai et al. | |
| 6,106,179 | A * | 8/2000 | Kuo | 401/30 |
| 6,386,781 | B1 | 5/2002 | Gueret | |
| 6,695,510 | B1 * | 2/2004 | Look et al. | 401/68 |
| 6,895,628 | B1 | 5/2005 | Anderson | |
| 7,147,393 | B2 | 12/2006 | Yoon | |
| 7,156,571 | B2 | 1/2007 | Mook et al. | |
| 7,168,875 | B1 * | 1/2007 | Zhang et al. | 401/174 |
| 7,290,055 | B2 | 10/2007 | Tripathi | |
| 7,309,184 | B2 | 12/2007 | Butcher et al. | |
| 7,435,027 | B2 * | 10/2008 | Hetzel | 401/47 |
| 2,129,051 | A1 | 9/2011 | Clarke | |
| 2008/0014163 | A1 | 1/2008 | Grabiner et al. | |
| 2009/0232579 | A1 | 9/2009 | Obereisenbuchner et al. | |

FOREIGN PATENT DOCUMENTS

| | | | |
|---|---|---|---|
| EP | 2100533 | A1 | 9/2009 |
| JP | 11113631 | A2 | 4/1999 |
| JP | 3115404 | U | 11/2005 |
| TW | 347669 | | 12/1998 |
| TW | M297920 | U | 9/2006 |

* cited by examiner

MULTI-UNIT COSMETIC APPLICATOR

CROSS-REFERENCE TO RELATED APPLICATION

This patent application is a divisional of, and claims priority to, U.S. patent application Ser. No. 12/169,933, filed on Jul. 9, 2008, which is a continuation in part of U.S. patent application Ser. No. 11/818,027, filed on Jun. 13, 2007; which claims the benefit of and priority to U.S. Provisional Patent Application No. 60/900,369, filed on Feb. 8, 2007. The entirety of each of the aforementioned applications is incorporated herein in its entirety by reference.

BACKGROUND OF THE INVENTION

The present invention relates to applicators for applying a product to the body of the consumer; in particular, to a cosmetic applicator having at least multiple cosmetic units wherein one unit is independently movable with respect to the other units.

DISCUSSION OF THE PRIOR ART

Cosmetic applicators are designed to deliver a cosmetic agent such as lip gloss, mascara, lip liner, concealer, foundation, eye shadow and eyeliner, etc from a cosmetic unit. The cosmetic unit may be a solid, a liquid reservoir, or the like. Due to ease of design and manufacturing, applicators typically house only one cosmetic unit.

Thus, users must carry a variety of applicators. For example, when applying a lip gloss, it might be useful to also have a lip liner available. Thus, the user must remember to carry both items. This, of course, requires the number of items to carry and reduces the space needed to carry the items.

A need, therefore, exists for a simpler and easier to use cosmetic applicator that also avoids the known shortcomings of only having one cosmetic unit in a housing.

Even when a user carries all items with them, it may be that the cosmetic agents being used are incompatible. In the example above, the lip gloss may include ingredients that react adversely with the lip liner. The conflict may be relatively minor, liquefaction or smearing of one or the other cosmetic agent, to serious, burning or allergic reactions on the user's skin.

Thus, a further need exists for the delivery of cosmetic agents that are compatible with each other. Since cosmetic agents may have different physical states, typically liquid, solid, or amorphous, a need exists for the cosmetic applicator to deliver such compatible cosmetic agents in their state.

SUMMARY OF THE INVENTION

The needs are met by the present invention. Therein, a cosmetic applicator for dispensing at least a first and a second cosmetic agent on the skin of a user comprises housing having an inner space, a first cosmetic unit comprising the first cosmetic agent disposed in the housing, a second cosmetic unit comprising the second cosmetic agent disposed in the housing, and a means for advancing the second cosmetic unit relative to the first cosmetic unit from a stored position to an advanced position.

The means for advancement may be a slide assembly, a twist assembly, and/or a push button and spring assembly. The means for advancement may also be a dual twist assembly, a ratchet assembly, and squeeze assembly, and/or combinations of the above.

BRIEF DESCRIPTION OF THE DRAWINGS

The above and other features and advantages will become more readily apparent from a detailed description taken in conjunction with the following drawings, in which.

DETAILED DESCRIPTION OF THE INVENTION

Herein, "cosmetic agent" is used to denote the cosmetic that is applied to the user, while "cosmetic unit" is used to designate the physical formation that includes the cosmetic agent. For example, the lipstick components that are used to cover and/or enhance the lips of the user are the cosmetic agent, while the molded, typically cylindrical, form of the lipstick transported and used from the applicator is the cosmetic unit. Similarly, the liquid in a reservoir would be the cosmetic agent, while the reservoir is the cosmetic unit. One skilled in the art would understand the above not to be an exhaustive list.

With respect to FIGS. 1 and 2, in a first embodiment of the present invention, a multi-unit cosmetic applicator includes a first cosmetic unit and a second cosmetic unit that is movable with respect to the first cosmetic unit from a stored position to an advanced position via a slide assembly.

Herein, a "stored position" is when the second cosmetic unit is retracted in the housing, while an "advanced position" is when a user accessible portion, of any length, of the second cosmetic unit is extended beyond the housing so that the user can place the cosmetic agent comprised in the cosmetic unit onto their body.

Figure 1A:
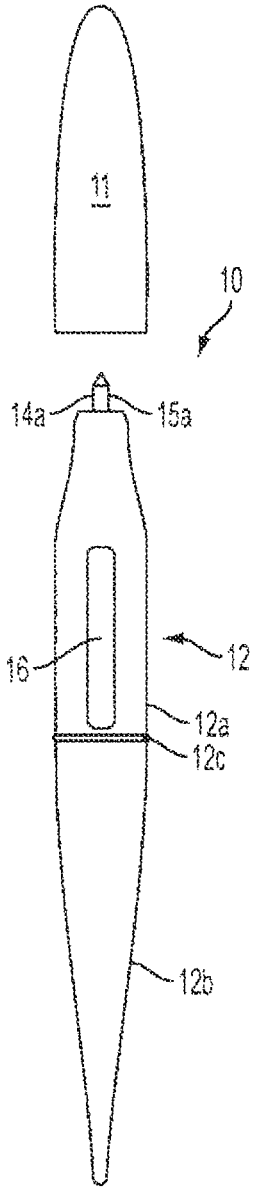
FIGS. 1*a* and 1*b* are front perspective views of a multi-unit cosmetic applicator in accordance with a first embodiment of the invention.
Figure 1B:
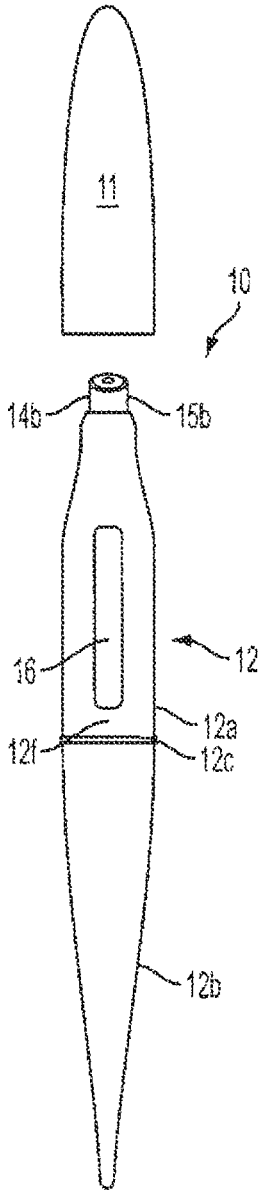
Figure 2A:
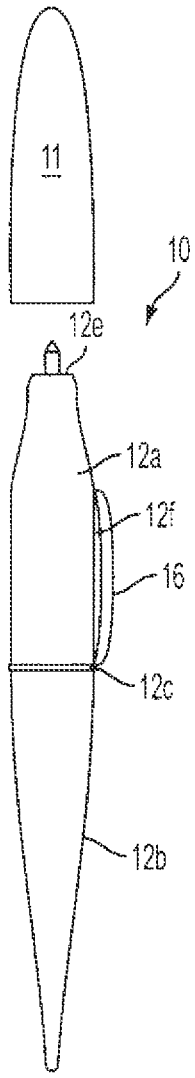
FIGS. 2*a*-2*c* are, respectively, a right-side view of a multi-unit cosmetic applicator in accordance with the first embodiment of the present invention, a front view of a dual cosmetic applicator thereof and a cross-sectional view of a dual cosmetic applicator thereof taken along line B-B of FIG. 2*b*.
Figure 2B:
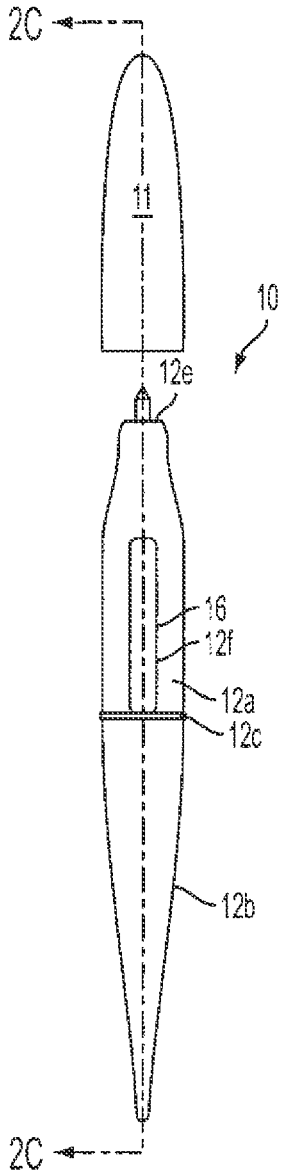
Figure 2C:
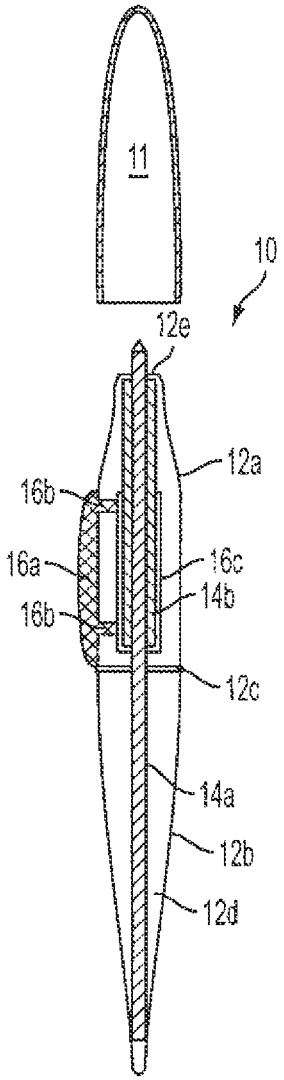

Therein, FIGS. 1*a* and 1*b* are front perspective views of a multi-unit cosmetic applicator 10 in accordance with a first embodiment of the invention. FIGS. 2*a*-2*c* are, respectively, a right-side view of multi-unit cosmetic applicator 10, a front view of multi-unit cosmetic applicator 10, and a cross-sectional view of multi-unit cosmetic applicator 10 taken along line B-B of FIG. 2*b*.

Preferably, multi-unit cosmetic applicator 10 is made of plastic, metal, and/or thermoplastic elastomers, rubber, manufactured using blow molding, and assembled by snap-fit assembly. However, any other material, manufacturing, and/or assembly method may be used. Especially desired is to have certain portions of the housing made with anodized plastic materials to give an upscale and refined look.

Multi-unit cosmetic applicator 10 includes a cap 11 and a housing 12. Cap 11 is preferably sized to fit over a substantial portion of an upper housing body 12*a* that is sealed via a sleeve 12*c* from a lower housing body 12*b*.

Lower body 12*b* comprises an inner space 12*d* that may be a void space or may be configured as a reservoir for a first cosmetic agent used by a first cosmetic unit 14*a*. Upper body 12*a* defines a substantially longitudinal inner space that primarily houses a second cosmetic unit 14*b* and the means to advance the second cosmetic unit relative to the first.

Housing 12 preferably is designed to have an attractive shape and yet be ergonomically designed to fit in the user's hand. An ergonomic design may include any desired shape that is found to be suitable. As illustrated, lower body 12*b* may be shaped to taper to a tip while upper housing body 12*a* has a broader, fuller shape.

Upper housing body 12*a* includes an opening 12*e*, suitable for passing both the first cosmetic unit 14*a* and the second cosmetic unit 14*b* through such an opening. Opening 12*e* defines a proximal end of housing 12, while the tip of lower body housing 12*b* defines a distal end. Upper housing body 12*a* also includes a substantially longitudinally oriented notch 12*f* into which a slider assembly 16 is fitted.

First cosmetic unit 14*a* preferably has a small width to length ratio and reaches well into inner space 12*d* to wick the first cosmetic agent. For example, cosmetic unit 14*a* may have a pencil lead shape, one that is substantially cylindrical in cross-section and has a significant length. Therein, cosmetic unit 14*a* extends the entire length of housing 12 and extends a portion beyond the proximal end of housing 12 to provide a user accessible portion 15*a*.

In contrast, second cosmetic unit 14*b* comprises a second cosmetic agent and preferably has greater width to length ratio than the first cosmetic unit 14*a*. For example, second cosmetic unit 14*b* has a lipstick shape, one that is substantially cylindrical in cross-section and is relatively shorter than the first cosmetic unit.

Cosmetic unit 14*b* is disposed about cosmetic unit 14*a* and, thus, includes longitudinal channel 14*c* that accommodates the first cosmetic unit 14*a*. Channel 14*c* extends longitudinally through the second cosmetic unit 14*b* and may have any suitable cross-sectional shape that permits the cosmetic unit 14*b* to move unimpeded relative to the first cosmetic unit. Thus, it should be appreciated that channel 14*c* includes a peripheral clearance about cosmetic unit 14*a*.

Using the slider assembly (to be taught hereinafter), the second cosmetic unit is selectably moved relative to the first cosmetic unit from a stored position in housing 12 (FIG. 1*a*) so that a user accessible portion 15*b*, of any length, of the second cosmetic unit 14*b* extends beyond the distal end of the housing (FIG. 1*b*).

Therein, for example, cosmetic unit 14*a* may be a lip liner, which has a diameter significantly smaller than the second cosmetic unit 14*b*, such as a lip gloss. The first cosmetic units may be a solid, semi-solid or waxy product such as an eye pencil, eye liner, mascara, lipstick, lip liner, lip balm, brow definer, concealer, foundation, blush, etc.

To move the second cosmetic unit, multi-unit cosmetic applicator 10 includes a slider assembly 16. Slider 16 may include a button 16*a* having a textured surface to provide a tactile response to the user. Slider assembly 16 includes spaced apart arms 16*b* that connect to a sleeve 16*c* that retains the second cosmetic unit. Sleeve 16*c* preferable includes a transverse floor that has an opening of a size suitable for permitting the movement of the second cosmetic unit relative to the first.

When the user pushes slider assembly 16 via button 16*a*, longitudinally towards the opening and the housing 12*d*, the second cosmetic unit 14 advances through the opening 12*d* and a portion 15*b* is suitably located for a user.

With respect to FIGS. 3 and 4, in a second embodiment of the present invention, a multi-unit cosmetic applicator includes a first housing portion that rotates relative to a second housing portion and advances a second cosmetic agent relative to a first cosmetic agent from a stored position to an advanced position.

Figure 3A:
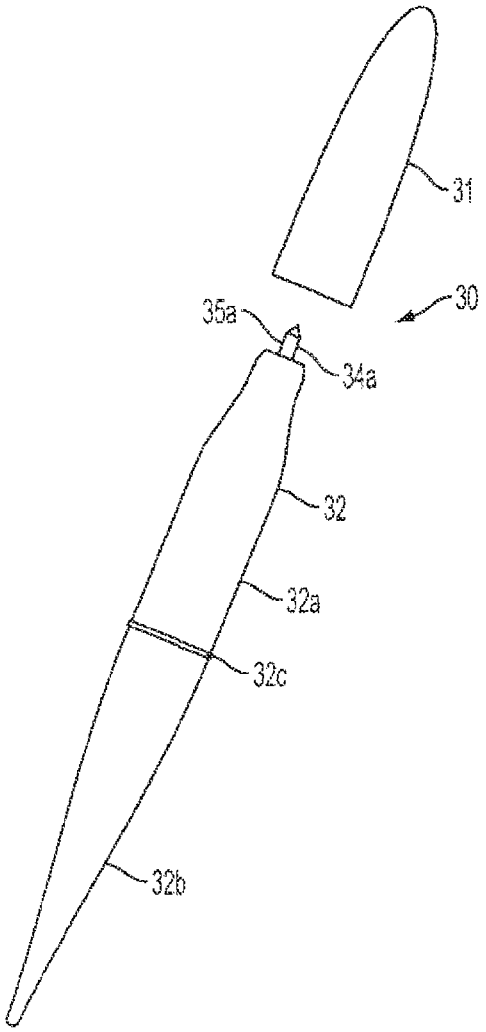
FIGS. 3*a* and 3*b* are perspective views of a multi-unit cosmetic applicator in accordance with the second embodiment of the invention.
Figure 3B:
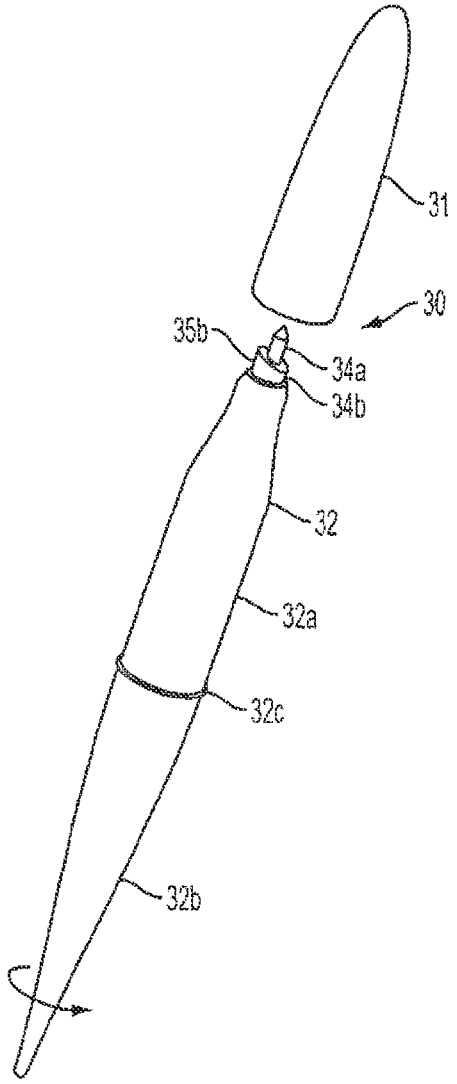
Figure 4A:
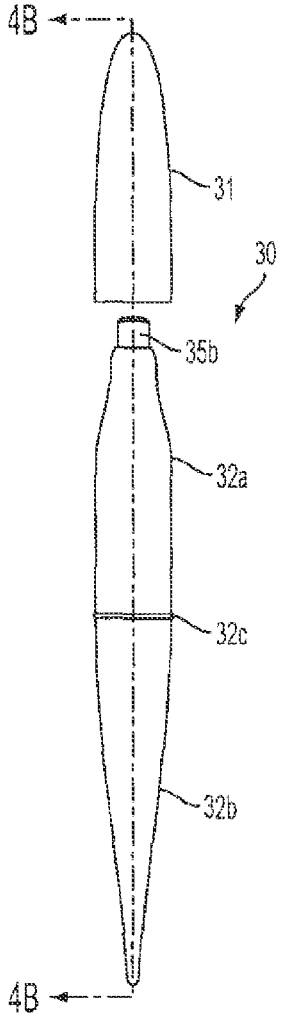
FIGS. 4*a*-4*c* are, respectively, a front view of multi-unit cosmetic applicator of the second embodiment of the present invention in an advanced position, a cross-sectional view of a dual cosmetic applicator thereof taken along line A-A of FIG. 4*a*, and a see-through view of a dual cosmetic applicator thereof in an advanced position.
Figure 4B:
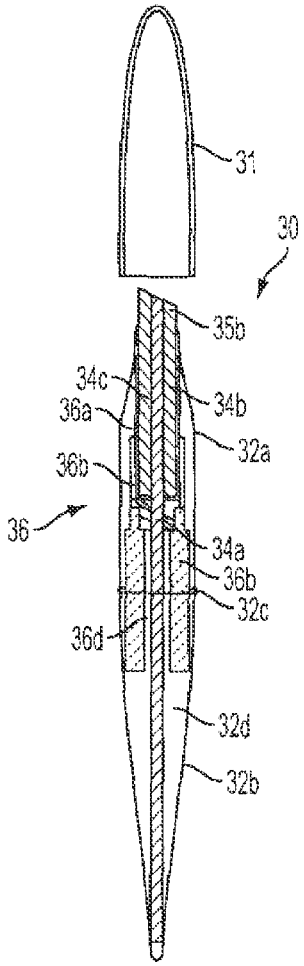
Figure 4C:
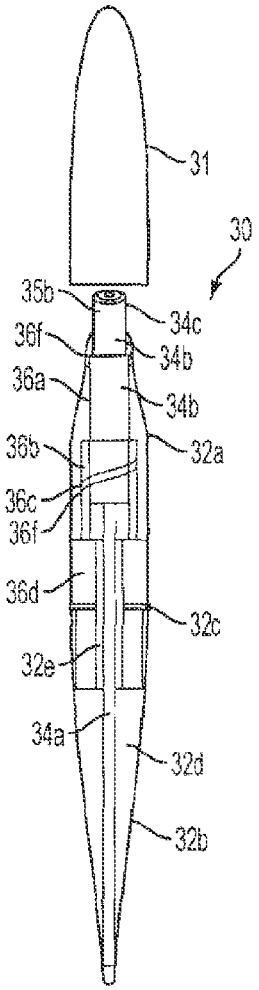

Therein, FIGS. 3*a* and 3*b* are perspective views of a multi-unit cosmetic applicator 30 in accordance with the second embodiment of the invention. FIGS. 4*a*-4*c* are, respectively, a front view of cosmetic applicator 30 in an advanced position, a cross-sectional view of cosmetic applicator 30 taken along line A-A of FIG. 4*a*, and a see-through view of cosmetic applicator 30 in an advanced position.

Preferably, multi-unit cosmetic applicator 30 is made of plastic, metal, and/or thermoplastic elastomers, rubber, manufactured using blow molding, and assembled by snap-fit assembly. However, any other material, manufacturing, and/or assembly method may be used. Especially desired is to have certain portions of the housing made with anodized plastic materials to give an upscale and refined look.

Therein, cosmetic applicator 30 includes a cap 31 and a housing 32. Cap 31 is preferably sized to fit over a substantial portion over an upper housing body 32*a* that is sealed via a sleeve 32*c* from a lower body 32*b*.

Lower housing body 32*b* comprises an inner space 32*d* which may be configured as a void space or a reservoir for a first cosmetic agent used by a first cosmetic unit 34*a*. Upper body 32*a* defines a substantially longitudinal inner space that primarily houses a second cosmetic unit 34*b* and the means to advance the second cosmetic unit relative to the first.

Similar to multi-unit cosmetic applicator 10, herein, the first cosmetic unit 34*a* preferably has a small width to length ratio and reaches well into inner space 32*d* to wick the first cosmetic agent. For example, cosmetic unit 14*a* may have a pencil lead shape, one that is substantially cylindrical in cross-section and has a significant length. Therein, cosmetic unit 34*a* extends the entire length of housing 32 and extends a portion beyond the proximal end of housing 32 to provide a user accessible portion 35*a*.

In contrast, second cosmetic unit 34*b* comprises a second cosmetic agent and preferably has greater width to length ratio than the first cosmetic unit 34*a*. For example, second cosmetic unit 34*b* has a lipstick shape, one that is substantially cylindrical in cross-section and is relatively shorter than the first cosmetic unit.

Cosmetic unit 34*b* is disposed about cosmetic unit 34*a* and, thus, includes longitudinal channel 34*c* that accommodates the first cosmetic unit 34*a*. Channel 34*c* extends longitudinally through the second cosmetic unit 34*b* and may have any suitable cross-sectional shape that permits the cosmetic unit 34*b* to move unimpeded relative to the first cosmetic unit. Thus, it should be appreciated that channel 34*c* includes a peripheral clearance about cosmetic unit 34*a*. In one embodiment, cosmetic unit 34*a* is anchored at a distal end of body 32*b*.

Using the twist assembly (to be taught hereinafter), the second cosmetic unit is selectably moved relative to the first cosmetic unit from a stored position in housing 32 (FIG. 3*a*) so that a user accessible portion 35*b*, of any length, of the second cosmetic unit 14*b* extends beyond the distal end of the housing (FIG. 3*b*).

Therein, for example, cosmetic unit 34*a* may be a lip liner, which has a diameter significantly smaller than the second cosmetic unit 34*b*, such as a lip gloss. The first cosmetic units may be a solid, semi-solid or waxy product such as an eye pencil, eye liner, mascara, lipstick, lip liner, lip balm, brow definer, concealer, foundation, blush, etc.

To move the second cosmetic unit, multi-unit cosmetic applicator 30 includes a twist assembly 36. Twist assembly 36 includes a sleeve 36*a* that houses the second cosmetic unit 34*b* and a plug 36*b* configured to include a helical guide 36*c* and cylinder 36*d* having a channel 36*e*.

An upper portion of plug 36*b* fits within the upper housing body 32*a* while a lower portion comprising approximately half of cylinder 36*c* is disposed in lower housing body 32*b*. Therein, body 32*b* is rotatable with respect to body 32*a* and rotates with twist assembly 36. Thus, in essence, the lower portion of the cosmetic applicator rotates, while the upper portion of the body is still and the cosmetic unit is advanced longitudinally.

Sleeve 36*a* further includes spaced-apart pins 36*f* that travel in guide 36*c* and is keyed to body 32*a* in an inner peripheral groove disposed on body 32*a*. Guide 36*c* is disposed in the interior surface of the sleeve and is shaped to have a helical surface. By rotating lower housing body 32*b*, the sleeve twists and moves with respect to the axis of multi-unit applicator 30.

With respect to FIGS. 5 and 6, in a third embodiment of the present invention, a multi-unit cosmetic applicator includes a first cosmetic unit and a second cosmetic unit that is movable with respect to the first cosmetic unit from a stored position to an advanced position via a push button and spring assembly.

Figure 5A:
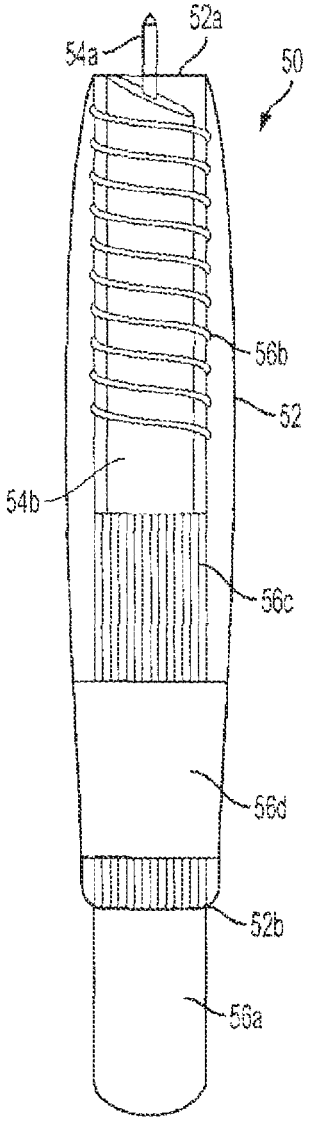
FIGS. 5*a* and 5*b* are front perspective views of a multi-unit cosmetic applicator in accordance with third embodiment of the invention.
Figure 5B:
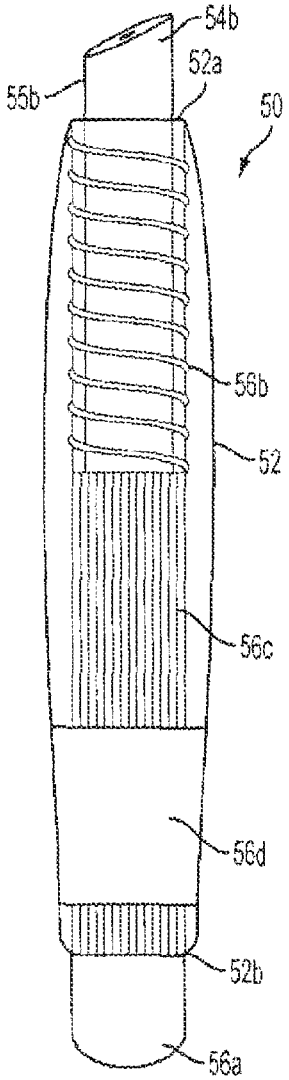
Figure 6A:
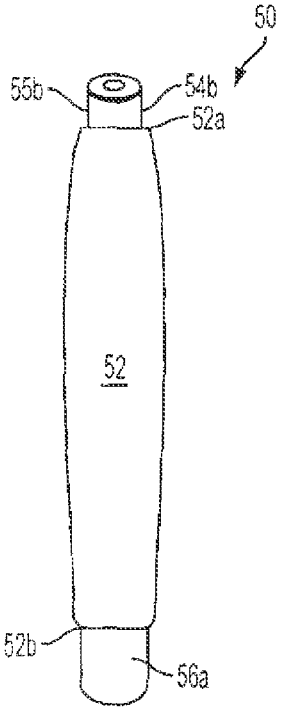
FIGS. 6*a*-6*c* are, respectively, a right-side view of multi-unit cosmetic applicator of the third embodiment of the present invention, a front view of a dual cosmetic applicator thereof, and a cross-sectional view of a multi-unit cosmetic applicator taken along line A-A of FIG. 6*b*.
Figure 6B:
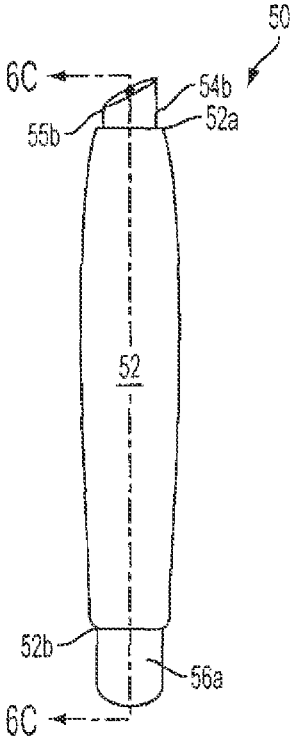
Figure 6C:
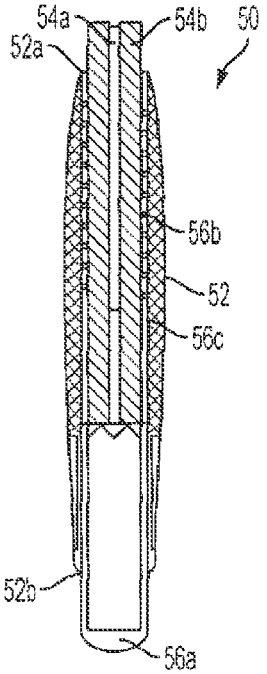

Therein, FIGS. 5*a* and 5*b* are front perspective views of multi-unit cosmetic applicator 50 in accordance with one embodiment of the invention wherein certain portions of the housing are shown translucent. FIGS. 6*a*-6*c* are, respectively, a right-side view of multi-unit cosmetic applicator 50, a front view of multi-unit cosmetic applicator 10, and a cross-sectional view of multi-unit cosmetic applicator 50 taken along line A-A of FIG. 6*b*.

Preferably, multi-unit cosmetic applicator 50 is made of plastic, metal, and/or thermoplastic elastomers, rubber, manufactured using blow molding, and assembled by snap-fit assembly. However, any other material, manufacturing, and/or assembly method may be used. Especially desired is to have certain portions of the housing made with anodized plastic materials to give an upscale and refined look.

Multi-unit cosmetic applicator 50 may include a cap not shown and a housing 52. The cap if provided is preferably sized to fit over a substantial portion of an upper portion of housing 52.

The housing defines a substantially longitudinal inner space that houses a first cosmetic unit 54*a*, a second cosmetic unit 54*b*, a spring that in conjunction with a push button advance the second cosmetic unit relative to the first cosmetic unit.

Housing 52 preferably is designed to have an attractive shape and yet be ergonomically designed to fit in the user's hand. An ergonomic design may include any desired shape that is found to be suitable.

Housing 52 comprises a proximal opening 52*a* suitable for passing both the first cosmetic unit 54*a* and the second cosmetic unit 54*b* through such an opening and a distal opening 52*b* wherein a push button (to be taught hereinafter) is disposed.

First cosmetic unit 54*a* preferably has a small width to length ratio and is anchored at distal opening 52*b*. For example, cosmetic unit 54*a* may have a pencil lead shape, one that is substantially cylindrical in cross-section and has a significant length. Therein, cosmetic unit 54*a* extends a portion of the length of housing.

In contrast, second cosmetic unit 54*b* comprises a second cosmetic agent and preferably has greater width to length ratio than the first cosmetic unit 54*a*. For example, second cosmetic unit 54*b* has a lipstick shape, one that is substantially cylindrical in cross-section and is relatively shorter than the first cosmetic unit.

Cosmetic unit 54*b* is disposed about cosmetic unit 54*a* and, thus, includes longitudinal channel 54*c* that accommodates the first cosmetic unit 54*a*. Channel 54*c* extends longitudinally through the second cosmetic unit 54*b* and may have any suitable cross-sectional shape that permits the cosmetic unit 54*b* to move unimpeded relative to the first cosmetic unit. Thus, it should be appreciated that channel 54*c* includes a peripheral clearance about cosmetic unit 54*a*.

Using the push button and spring (to be taught hereinafter), the second cosmetic unit is selectably moved relative to the first cosmetic unit from a stored position in housing 52 (FIG. 5*a*) so that a user accessible portion 55*b*, of any length, of the second cosmetic unit 54*b* extends beyond the distal end of the housing (FIG. 5*b*).

Therein, for example, cosmetic unit 54*a* may be a lip liner, which has a diameter significantly smaller than the second cosmetic unit 54*b*, such as a lip gloss. The first cosmetic units may be a solid, semi-solid or waxy product such as an eye pencil, eye liner, mascara, lipstick, lip liner, lip balm, brow definer, concealer, foundation, blush, etc.

To move the second cosmetic unit, multi-unit cosmetic applicator 50 includes a push button 56*a*, a spring 56*b*, and a sleeve 56*c*. Spring 56*b* is biased against sleeve 56*c*. Sleeve 56*c* is substantially cylindrical and retains a lower portion of second cosmetic unit 54*b*. Push button 56*a* is biased against the sleeve at a lower edge of the sleeve or is integral with the sleeve, while spring 56*b* is biased against the sleeve at an upper edge of the sleeve. Spring 56*a* is biased at a proximal edge against a peripheral rim of opening 52*a*. A substantially cylindrical guide 56*d* is retained in a lower part of housing 52 to limit the travel of the push button by engaging a proximal protrusion of the push button.

When the push button is depressed by the user, the second cosmetic unit moves relative to the first cosmetic unit via push button means as are known for example in a pen.

With regard to the embodiments of FIGS. 1-6, the first cosmetic unit, inner unit, comprises and delivers a liquid cosmetic agent. The liquid cosmetic agent may be, but is not limited, to skin treatment serums, lotions, solutions, sunscreen preparations, self-tanning preparations, color enhancing preparations, shine enhancing preparations, preparations that include film formers to improve wear resistant attributes, perspiration and moisture resistance properties; a rubefacient, cosmetics colorants, optical brighteners, glitter or fluorescent materials as desired for additional visual effects.

To do so, the cosmetic unit may comprise suitable natural and synthetic substrate materials that include, but are not limited, to cotton, flax, silk or polyesters, rayons, acrylics, acetates, triacetates, polyolefins, and lyocells. Such substrate materials can be impregnated with the liquid cosmetic agent for subsequent delivery during use of the first cosmetic unit. Preferred are highly absorbent substrate materials.

In one or more embodiments related to the embodiments of FIGS. 1-6, the first cosmetic unit, inner unit, rather than comprising and delivering a liquid cosmetic agent comprises and delivers a solid, semi-solid, or waxy cosmetic agent. Therein, each of the embodiments comprises a take-up mechanism that maintains a sufficient user accessible portion 15*a*, 35*a*, or 55*a* of the cosmetic unit external to the housing.

Such a take up mechanism may be automatic such as a spring assembly or a manually where the user engages the first cosmetic unit and advances it forward.

In one or more embodiments related to the embodiments of FIGS. 1-6 or unrelated thereto, an outer cosmetic unit may comprise and deliver a liquid cosmetic agent. Thus, FIGS. 7-9 illustrate a fourth embodiment of a multi-unit cosmetic applicator in accordance with one embodiment of the present invention.

Figure 7B:
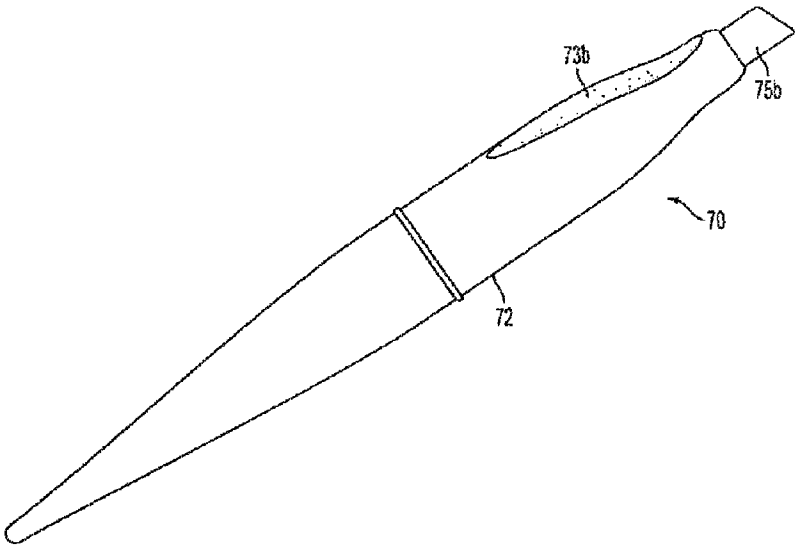
FIGS. 7*a* and 7*b* are front perspective views of a multi-unit cosmetic applicator in accordance with a fourth embodiment of the invention.
Figure 7A:
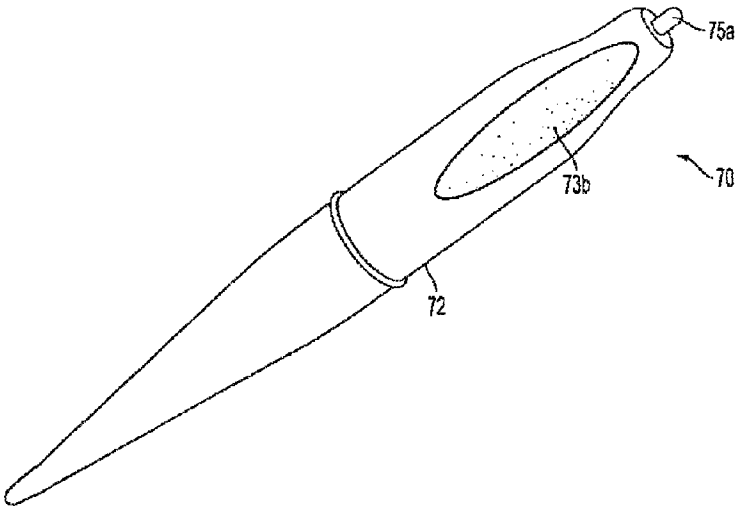
Figure 9A:
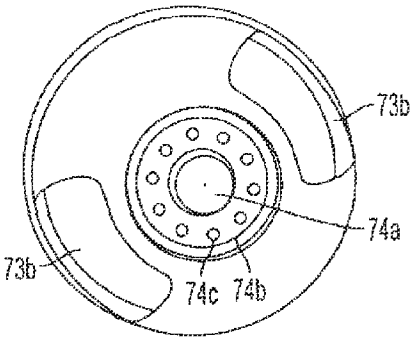
FIGS. 9*a* and 9*b* are top perspective views thereof.
Figure 8:
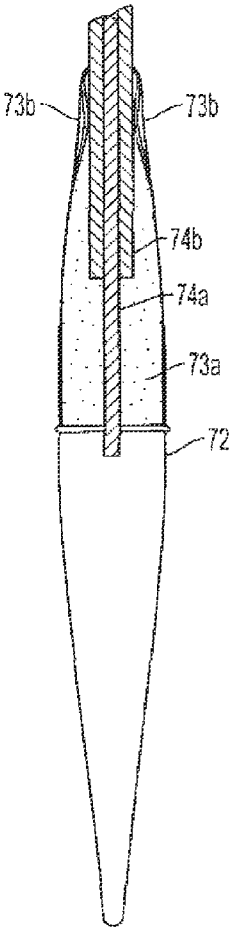
FIG. 8 is a cross-sectional view of the multi-unit cosmetic applicator thereof.

Therein, FIGS. 7*a* and 7*b* are front perspective views of multi-unit cosmetic applicator 70 in accordance with one embodiment of the invention. FIG. 8 is a cross-sectional view of the multi-unit cosmetic applicator thereof and FIGS. 9*a* and 9*b* are top perspective view thereof.

Multi-unit cosmetic applicator 70 may be constructed substantially in the same manner as taught with respect to any of the foregoing embodiments and having means to advance the second cosmetic unit, herein cosmetic unit 74*b*, relative to a first cosmetic unit, herein cosmetic unit 74*a*. The units are sized to substantially permit movement of the second cosmetic unit 74*b* relative to the first and advance a user accessible portion 75*b* external to housing 72 to deliver a second cosmetic agent. When the second cosmetic unit 74*b* is stored, a user accessible portion 75*a* of cosmetic unit 74*a* is external to the housing to deliver a first cosmetic agent.

Housing 72 preferably includes inner space 73*a* which may be a void space or may be usable as a reservoir for the second cosmetic agent. Therein, inner space 73*a* is preferably sealed from any other reservoir. One or more flexible housing portions 73*b* are disposed in fluid communication with inner space 73*a* to infuse the second cosmetic unit with the second cosmetic agent.

Figure 9B:
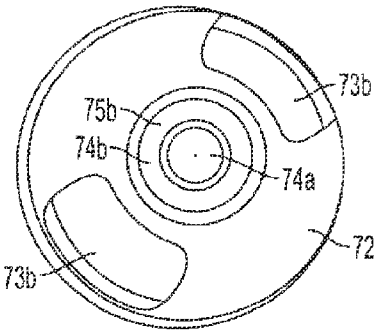

To permit advantageous delivery of the cosmetic agent at a proximal surface of cosmetic unit 74*b*, a plurality of apertures 74*c* (FIG. 9*a*) as opposed to a smooth surface (FIG. 9*b*). Each of the cosmetic units may vary in size to allow for controlled application to varying areas and to allow for variable dosage or step treatments.

With respect to FIGS. 10, 11, and 12, in a further embodiment of the present invention, a multi-unit cosmetic applicator includes a first, second, and third cosmetic unit that are movable with respect to each other and the housing from a stored position to an advanced position via one or more slide assemblies.

Herein, a "stored position" is when a cosmetic unit is retracted in the housing, while an "advanced position" is when a user accessible portion, of any length, of the second cosmetic unit is extended beyond the housing so that the user can place the cosmetic agent comprised in the cosmetic unit onto their body.

Although, the embodiment of FIGS. 10, 11, and 12 are illustrated with respect to three cosmetic units, limiting the number of cosmetic units and means to advance the cosmetic units to two or increasing the number of cosmetic units and means to advance the cosmetic units to four (4) or greater is also encompassed by the present embodiment.

Figure 10A:
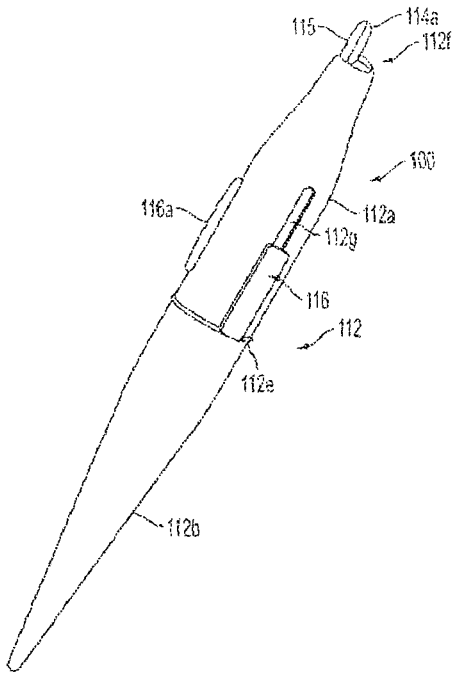
FIGS. 10*a* and 10*b* are, respectively, a right-side perspective view and a left-side perspective view, as of a multi-unit cosmetic applicator in accordance with a further embodiment of the invention.
Figure 10B:
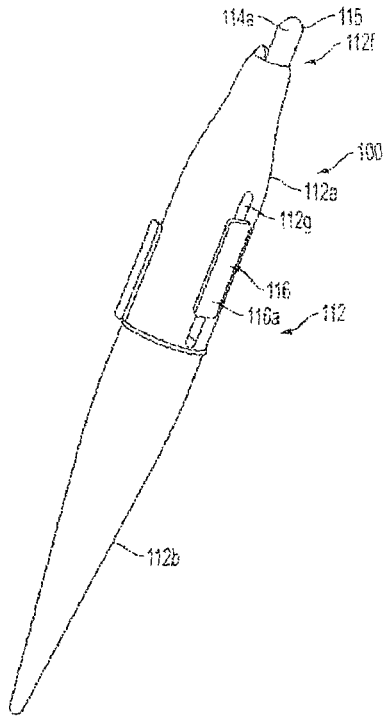
Figure 11A:
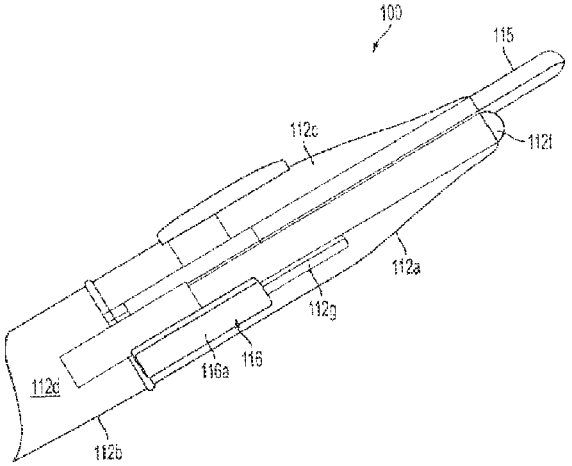
FIGS. 11*a* and 11*b* are, respectively, a front perspective view and a top view of multi-unit cosmetic applicator.
Figure 11B:
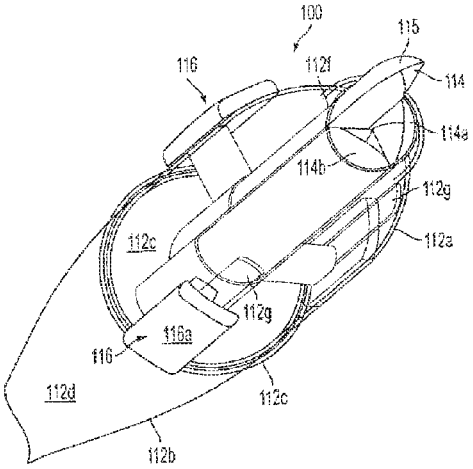
Figure 12A:
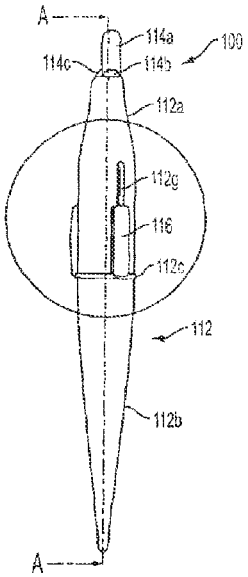
FIGS. 12*a*-12*e* are, respectively, a right-side view of a multi-unit cosmetic applicator, a side partial see-through view of a multi-unit cosmetic applicator, a top partial see-through view of a multi-unit cosmetic applicator, a cross-sectional view of a dual cosmetic applicator taken along line A-A of FIG. 12*a*, and a partial see-through view of a detail of area B of FIG. 12*a*.
Figure 12B:
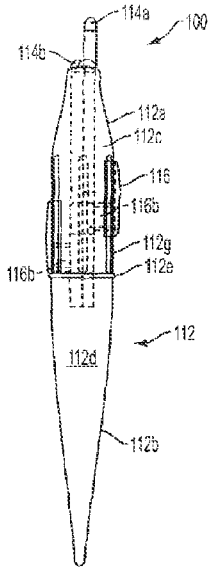
Figure 12D:
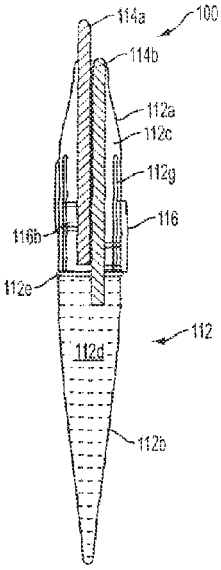
Figure 12C:
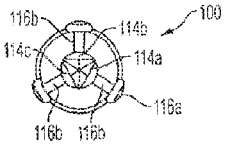
Figure 12E:
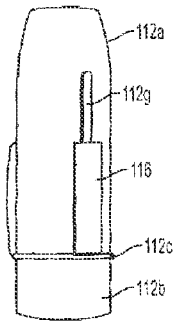

Therein, FIGS. 10*a* and 10*b* are, respectively, a right-side perspective view and a left-side perspective view, as of a multi-unit cosmetic applicator 100 in accordance with a further embodiment of the invention. FIGS. 11*a* and 11*b* are, respectively, a partial see-through side view and front perspective view of multi-unit cosmetic applicator 100. FIGS. 12*a*-12*e* are, respectively, a right-side view of multi-unit cosmetic applicator 100, a side partial see-through view of multi-unit cosmetic applicator 100, a top partial see-through view of multi-unit cosmetic applicator 100, a cross-sectional view of dual cosmetic applicator 100 taken along line A-A of FIG. 12*a*, and a partial see-through view of a detail of area B of FIG. 12*a*.

Preferably, multi-unit cosmetic applicator 100 is made of plastic, metal, and/or thermoplastic elastomers, rubber, manufactured using blow molding, and assembled by snap-fit assembly. However, any other material, manufacturing, and/or assembly method may be used. Especially desired is to have certain portions of the housing made with anodized plastic materials to give an upscale and refined look.

Multi-unit cosmetic applicator 100 includes a housing 112 having an upper body 112*a* and a lower body 112*b* that are fixedly or removably joined by any known means. Upper body 112*a* defines a substantially longitudinal inner space 112*c* for one or more slider assemblies and cosmetic units. Lower body 112*b* comprises an inner space 112*d* configured to receive a portion of one or more cosmetic units when in a stored position.

Inner space 112*d* may be a void space or may also comprise one or more reservoirs that may each house a different cosmetic agent or the same cosmetic agent such as one taught in this application. If the cosmetic agent is fluid one or more reservoirs may be in fluid communication with one or more corresponding cosmetic units.

Housing 112 preferably is designed to have an attractive shape and yet be ergonomically designed to fit in the user's hand. An ergonomic design may include any desired shape that is found to be suitable. As illustrated, lower body 112*b* may be shaped to taper to a tip while upper housing body 112*a* has a broader, fuller shape. The upper and lower body may be joined together via a ring portion 112*e*.

Upper housing body 112*a* includes an opening 112*f*, suitable for passing a first cosmetic unit 114*a*, a second cosmetic unit 114*b*, and third cosmetic unit 114*c* through such an opening. Opening 112*f* defines a proximal end of housing 112, while the tip of lower body housing 112*b* defines a distal end. Upper housing body 112*a* also includes substantially one or more longitudinally oriented notches 112*g* into which a corresponding slider assembly 116 (to be taught hereinafter) are fitted.

Each of three cosmetic units has a substantially longitudinal shape that when in a stored position extends from a proximal end of housing 112 through inner space 112*c* into inner space 112*d* at the distal end of the cosmetic unit. In cross-section, each cosmetic unit may have any shape. It may be preferred for each cosmetic unit to represent portion of a larger unit; for example, a segment of a circle or a portion of a triangle. To permit unimpeded independent movement; each cosmetic unit is laterally spaced-apart from another. Thus, it should be appreciated that opening 112*f* includes a peripheral clearance to permit movement of the cosmetic units.

Using the slider assembly (to be taught hereinafter), each cosmetic unit is selectably moved relative to the other cosmetic units from a stored position in housing 112 so that a user accessible portion 115, of any length, of one or more cosmetic units extends beyond the distal end of the housing. When in an advanced position, each of the cosmetic units extends a portion beyond the proximal end of housing 112 to provide a respective user accessible portion 115.

To move the cosmetic units, multi-unit cosmetic applicator 100 includes one or more slide assembly 116. Each slide assembly 116 may include a button 116*a* having a textured surface to provide a tactile response to the user. Each slide assembly 116 includes an arm 116*b* that connects to a sleeve 116*c* to retain one of the cosmetic units.

When the user pushes slide assembly 116 via button 116*a*, longitudinally towards the opening and the housing, the respective cosmetic unit advances through the opening 112*f* and a portion 115 is suitably located for a user.

Figure 13A:
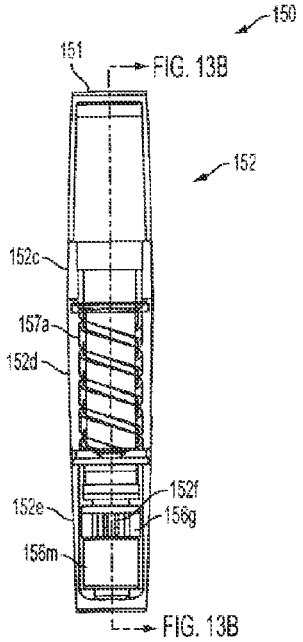
FIGS. 13*a*-13*d* are, respectively, a see-through front view of a multi-unit cosmetic applicator in a stored position, a cross-sectional view of a multi-unit cosmetic applicator taken along line A-A of FIG. 13*a*, an interior view of a partially opened a multi-unit cosmetic applicator in a stored position, and an exploded view of a multi-unit cosmetic applicator.
Figure 13B:
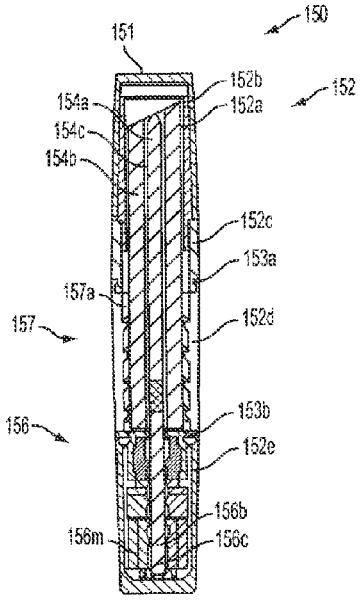
Figure 13C:
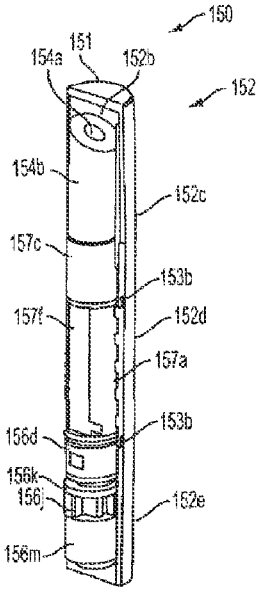
Figure 13D:
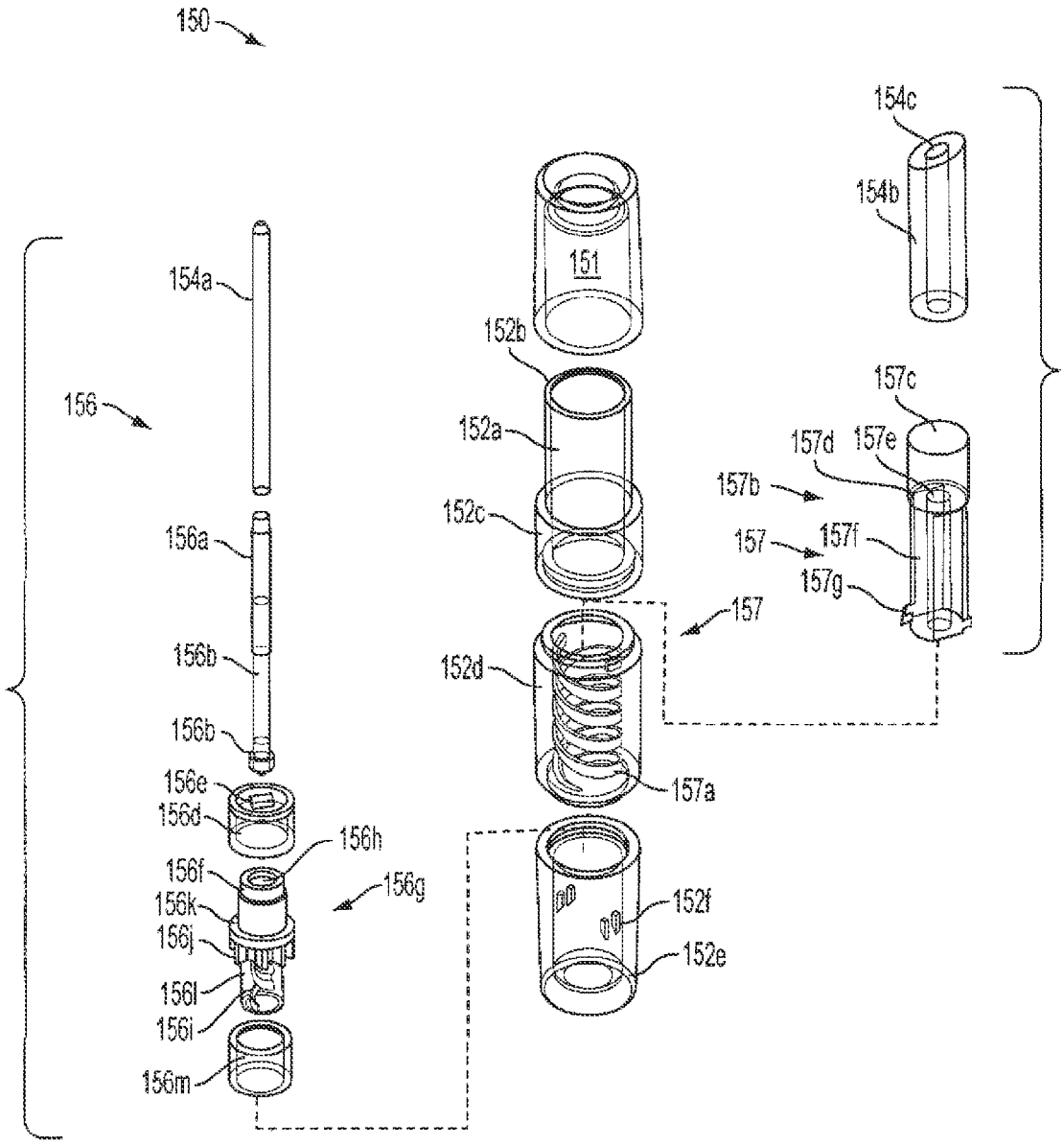

In accordance with one or more embodiments of the present invention, FIGS. 13*a*-13*d* are, respectively, a see-through front view of a multi-unit cosmetic applicator 150 in a stored position, a cross-sectional view of a multi-unit cosmetic applicator 150 taken along the cross-sectional line of FIG. 13*a*, an interior view of a partially opened multi-unit cosmetic applicator 150 in a stored position, and an exploded view of multi-unit cosmetic applicator 150.

Herein, a "stored position" is when a cosmetic unit is retracted in the housing, while an "advanced position" is when a user accessible portion, of any length, of the second cosmetic unit is extended beyond the housing so that the user can place the cosmetic agent comprised in the cosmetic unit onto their body.

Preferably, multi-unit cosmetic applicator 150 is made of plastic, metal, and/or thermoplastic elastomers, rubber, manufactured using blow molding, and assembled by snap-fit assembly. However, any other material, manufacturing, and/or assembly method may be used. Especially desired is to have certain portions of the housing made with anodized plastic materials to give an upscale and refined look.

Multi-unit cosmetic applicator 150 may include a cap 151 and a housing 152. The cap, if provided, is preferably sized to fit over a substantial portion of an upper portion of housing 152.

The housing may comprise an assembly of housing portions and defines a substantially longitudinal inner space that houses a first cosmetic unit 154*a*, a second cosmetic unit 154*b*, a dual twist assembly that comprises a first and second twist assembly 156, 157 that are movable independent of each other and selectively advance the first or second cosmetic unit relative to the other cosmetic unit.

For example, first cosmetic unit 154*a* may be a lip liner, which has a diameter significantly smaller than the second cosmetic unit 154*b*, such as a lipstick or a lip gloss. However, the first cosmetic units may be a solid, semi-solid or waxy product such as an eye pencil, eye liner, mascara, lipstick, lip liner, lip balm, brow definer, concealer, foundation, blush, etc.

First cosmetic unit 154*a* preferably has a small width to length ratio. For example, cosmetic unit 154*a* may have a pencil lead shape, one that is substantially cylindrical in cross-section and has a significant length. Therein, cosmetic unit 154*a* extends a portion of the length of housing.

In contrast, second cosmetic unit 154*b* comprises a second cosmetic agent and preferably has greater width to length ratio than the first cosmetic unit 154*a*. For example, second cosmetic unit 154*b* has a lipstick shape, one that is substantially cylindrical in cross-section and is relatively shorter than the first cosmetic unit.

Cosmetic unit 154*b* is disposed about cosmetic unit 154*a* and, thus, includes longitudinal channel 154*c* that accommodates the first cosmetic unit 154*a*. Channel 154*c* extends longitudinally through the second cosmetic unit 154*b* and may have any suitable cross-sectional shape that permits the cosmetic unit 154*b* to move unimpeded relative to the first cosmetic unit. Thus, it should be appreciated that channel 154*c* includes a peripheral clearance about cosmetic unit 154*a*.

Housing 152 preferably is designed to have an attractive shape and yet be ergonomically designed to fit in the user's hand. An ergonomic design may include any desired shape that is found to be suitable.

Housing 152 preferably is configured to be a have multiple annular sections and comprises a sleeve portion 152*a* that may be configured as an AG Shell and is preferably visually appealing to a user. The sleeve portion has a proximal opening 152*b* suitable for passing both the first cosmetic unit 154*a* and the second cosmetic unit 154*b* through such an opening and sleeve portion 152*a*.

Housing 152 further comprises a "stationary" housing portion 152*c* for grasping by the user while the first and/or second cosmetic units are advanced or retracted; an upper user portion 152*d*, i.e., second user portion 152*d*, that is also a portion of the second twist assembly for selectively advancing or retracting the second cosmetic unit 154*b* relative to the stationary housing portion 152*c*; and a lower user portion 152*e*, i.e., first user portion 152*e*, that is also a portion of the first twist assembly for selectively advancing or retracting the first cosmetic unit 154*a* relative to the stationary housing portion 152*c*. Sleeve portion 152*a* may be press fit, glued, sonically welded or in some other suitable way attached to stationary housing portion 152*c* and preferably does not move relative to the stationary housing portion.

Second user portion 152*d* and stationary housing portion 152*c* are joined at a circumferential or partially circumferential joint 153*a*. Preferably, joint 153*a* is formed by overlapping one reduced circumferential portion of either the second user portion or the stationary housing portion over a circumferential portion of the other, e.g., the other of the second user portion and the stationary housing portion.

Similarly, first user portion 152*e* and second user portion 152*d* are joined at a circumferential or partially circumferential joint 153*b*. Preferably, joint 153*b* is formed by overlapping one reduced circumferential portion of either the first user portion or the second user portion over a circumferential portion of the other, e.g., the other of the first user portion and the second user portion. By employing a mating notch and depression in each joint, the user portions and/or the stationary housing portion may be quickly assembled, positive seating may be ensured, and resistance to disengagement of the joined parts may be ensured.

User portion 152*e* preferably comprises a substantially cylindrical body that defines an inner space capped by a closed end, which when cosmetic applicator 150 assembled, is distal from opening 152*b* and includes one or more, preferably a pair, of protrusions 152*f* at a predetermined location.

To move the cosmetic unit 154*a*, multi-unit cosmetic applicator 150 includes twist assembly 156. Twist assembly 156 comprises a support assembly, which in turn, comprises a sleeve 156*a*, an extension 156*b*, and one or more tabs or pins 156*c*. Sleeve 156*a* and, preferably, a floor (not shown) laterally and longitudinally support and house the first cosmetic unit 154*a* and are connected to extension 156*b* that includes one or more, preferably a pair, of tabs or pins 156*c* at a distal end of the extension that engage a guide in a cam.

Twist assembly 156 further comprises a cap 156*d* that configured as a substantially cylindrical body and includes a top surface having a keyhole opening 156*e*. Opening 156*e* permits extension 156*b* and tabs or pins 156*c* to pass through during assembly and also permits the extension to move along a longitudinal axis of cosmetic applicator 150, but is designed to hold extension 156*b* without rotational play, e.g., prevents it from rotating relative to the cap to enable the support assembly to move relative to a cam. Thereto, extension 156*b* may comprise a particular cross-sectional shape that includes features to prevent rotation in the keyhole opening. Cap 156*d* further includes an open bottom that snaps or is fitted by some other means to proximal portion 156*f* of a cam 156*g*.

Twist assembly 156 further comprises cam 156*g*, which is configured to have a substantially cylindrical body having a channel 156*h*, e.g., throughbore. The interior wall of the cam, e.g., along the throughbore, includes one or more guides 156*i*, preferably helical, that extends substantially from a top opening of the cam to a bottom opening of the cam. The guide includes proximal and distal ends.

An exterior surface of the cam includes one or more protrusions 156*j* that are preferably joined to a stop 156*k*. Protrusions 156*j* preferably engage protrusions 152*f* such that cam 156*g* is maintained in a fixed rotational position relative to user portion 152*e*. Preferably, protrusions 152*f* engage stop 156*k* such that cam 156*g* is held at least a specified position spaced from the distal end of user portion 152*e*. To aid in engaging stop 156*k*, one or more of protrusions 152*f* include a substantially planar seat and stop 156*k* is configured to comprise a substantially planar surface that rests on the seat or seats.

Twist assembly 156 further comprises a cup 156*m* in which a bottom 1561 of cam 156*g* may be disposed to preferably reduce friction and/or aid in maintaining cam 156*g* oriented along the centerline of cosmetic applicator 150, e.g., away from inner wall of user portion 156*e* so that the cam and cosmetic unit 154*a* are properly aligned.

When twist assembly 156 is assembled, cup 156*m* is disposed toward the distal end of the inner space of user portion 152*e* and cam 156*g* is disposed in user portion 152*e* and supported by its stop 156*k* on protrusions 152*f*. The cam and the user portion will then turn substantially together when turned relative to other user portions. Cap 156*d* is fitted over cam 156*g* such that the cap rotates relative to the cam, e.g., user portion 152*e*. Further, the extension is inserted through the keyhole opening in the cap. Tabs or pins 156*c* are press fitted or by some other means made to engage the guide in the cam. When user portion 152*e* is turned relative to stationary housing portion 152*e*, the extension moves in the helical guide to extend and retract cosmetic unit 154*a*.

To move the second cosmetic unit, multi-unit cosmetic applicator 150 includes second twist assembly 157 which comprising one or more guides 157*a*, preferably helical, disposed in the interior wall of user portion 152*d* and a carrier 157*b* that is rotatably advanceable or retractable relative the user portion 152*d* and the stationary housing portion 152*c* when traveling in the guide.

Carrier 157*b* includes a sleeve portion 157*c* that supports the second cosmetic unit 154*b* laterally and a floor 157*d* that supports the bottom of second cosmetic unit 154*b*. Together the sleeve portion and the floor define the inner space that holds the second cosmetic unit. Floor 157*d* includes an opening 157*e* that permits passage of sleeve 156*a*, extension 156*b* and/or cosmetic unit 154*a*. To permit unimpeded independent movement; opening 157*e* includes a peripheral clearance about sleeve 156*a*, extension 156*b* and/or cosmetic unit 154*a*.

Carrier 157*b* further includes a lower portion 157*f* that may comprise a wall or be constructed as a solid portion. If constructed as solid portion to aid in guiding sleeve 156*a*, extension 156*b* and/or cosmetic unit 154*a*, opening 157*e* extends as a channel through the solid portion and preferably includes appropriate peripheral clearance. At a distal end of the carrier, one or more tabs or pins 157*g* are provided that engage helical guide 157*a*.

When twist assembly 157 is assembled, tabs or pins 156*g* are press fitted or by some other means made engage the helical guide in user portion 152*d*.

In use, the user may retrieve cosmetic applicator 150 from a storage location. Therein, the cosmetic applicator preferably is stored with cap 151 secured and, accordingly, the first and second cosmetic units are disposed in a stored position. The user removes cap 151 and selects either the first or the second cosmetic units to advance. For example, first cosmetic unit 154*a* is a lip liner; the user may select it first to outline the lips. Thus, the user grasps stationary housing portion 152*c* and user portion 152*e* and twists the user portion 152*e* while holding the stationary housing portion. Twisting housing portion 152*e* engages twist assembly 156 but not twist assembly 157. In fact, the user portion 152*d* does not twist or turn with user portion 152*e* due to construction of joint 153*b*.

Twisting housing portion 152*e* engages twist assembly 156 via protrusions 152*f* that engage protrusions 156*j* such that cam 156*g* is maintained in a fixed rotational position relative to user portion 152*e*, e.g., twists with user portion 152*e*. However, the support assembly, e.g., sleeve 156*a*, extension 156*b*, and pins or tabs 156*c*, moves relative to the cam in guide 156*i*. The tip of the cosmetic unit advances through opening 152*b* into a user-accessible position. If the user accidentally continues turning the user portion 152*e*, pins or tabs 156*c* reach a proximal end of the guide and the carrier will cease to advance. Once cosmetic unit 154*a* is in the user accessible position, the user can apply the agent.

The user then may wish to apply the cosmetic agent of second cosmetic unit 154*b*, for example, a lipstick. However, prior to that, the user preferably retracts first cosmetic unit by turning user portion 152*e* relative stationary housing portion 152*c* in the opposite direction when advancing cosmetic unit 154*a*. Twisting housing portion 152*e* once again engages twist assembly 156 via protrusions 152*f* that engage protrusions 156*j* such that cam 156*g* is maintained in a fixed rotational position relative to user portion 152*e*, e.g., twists with user portion 152*e*. However, the support assembly, e.g., sleeve 156*a*, extension 156*b*, and pins or tabs 156*c*, moves relative to the cam in guide 156*i*. The tip of the cosmetic unit retracts through opening 152*b* into a stored position. If the user accidentally continues turning the user portion 152*e*, pins or tabs 156*c* reach the distal end of the guide and the carrier will cease to retract. Once cosmetic unit 154*a* is in the stored position, the user can apply begin advancing the second cosmetic agent.

Thus, the user grasps stationary housing portion 152*c* and user portion 152*d* and twists the user portion 152*d* while holding the stationary housing portion. Twisting housing portion 152*d* engages twist assembly 157 but not twist assembly 156. In fact, the user portion 152*e* does not twist or turn with user portion 152*d* due to construction of joint 153*b*.

Twisting housing portion 152*d* engages twist assembly 157 via pins or tabs 157*f* of carrier 157*b*. The carrier 157*b* moves relative to the user portion 152*d*. The tip of cosmetic unit 154*b* advances through opening 152*b* into a user-accessible position. If the user accidentally continues turning the user portion 152*d*, pins or tabs 157*f* reach a proximal end of the guide and the carrier will cease to advance. Once cosmetic unit 154*b* is in the user accessible position, the user can apply the agent.

The user then may wish to store cosmetic applicator. In preparation, the user preferably retracts the second cosmetic unit by turning user portion 152*d* relative stationary housing portion 152*c* in the opposite direction when advancing cosmetic unit 154*b*. Twisting housing portion 152*d* once again engages twist assembly 157 via protrusions 157 and the carrier moves relative to housing portion 152*d*. The tip of the cosmetic unit retracts through opening 152*b* into a stored position. If the user accidentally continues turning the user portion 152*d*, pins or tabs 157*f* reach the distal end of the guide and the carrier will cease to retract. Once cosmetic unit 154*b* is in the stored position, the user can close the cosmetic applicator by securing cap 151.

It should be appreciated that the second cosmetic unit may be utilized prior to utilizing the first cosmetic unit and that the cosmetic units may retracted and advanced without a particular requirement to advance one and then retract it prior to advancing or retracting the other. However, utilizing the cosmetic applicator as described above permits a more user-friendly experience.

Figure 14A:
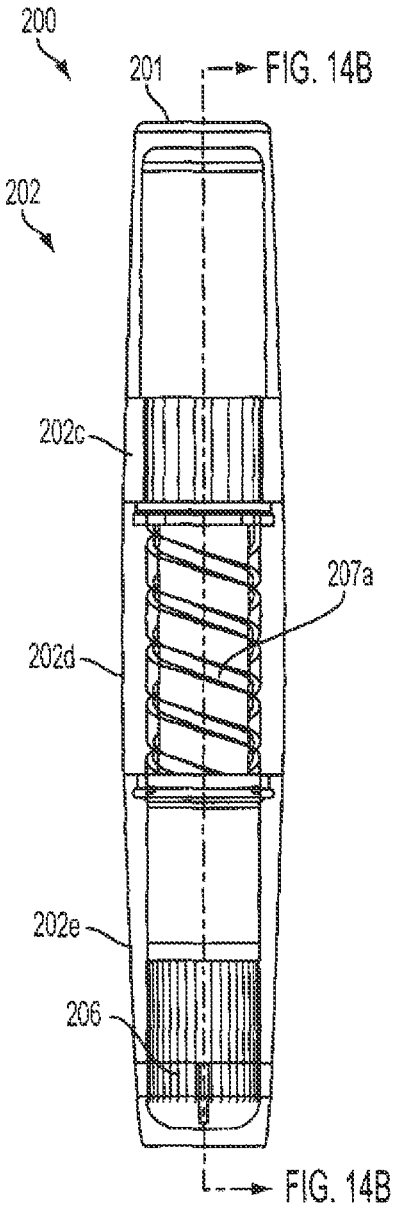
FIG. 14*a* is a see-through front view of a multi-unit cosmetic applicator in a stored position and FIG. 14*b* is a cross-sectional view of a multi-unit cosmetic applicator taken along the cross-sectional line of FIG. 14*a*.
Figure 14B:
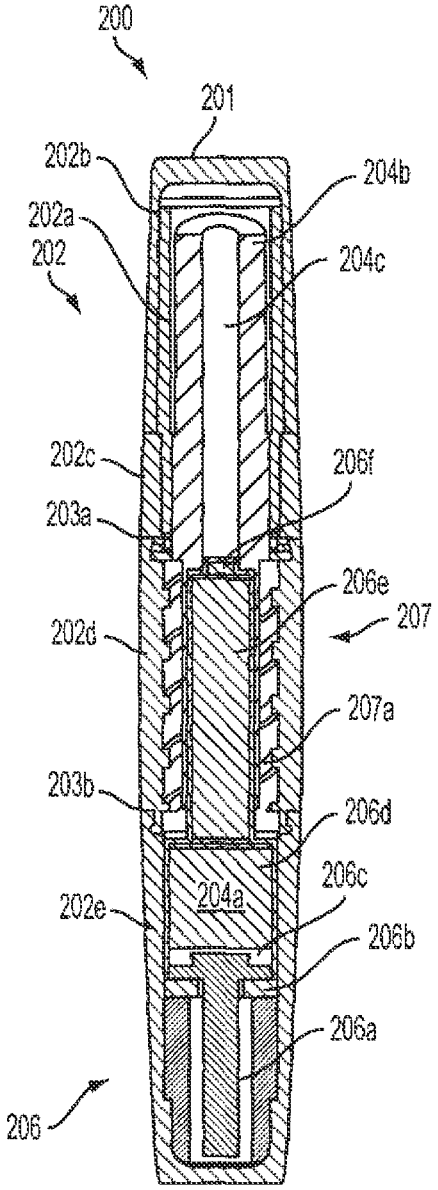

In accordance with one or more embodiments of the present invention, FIG. 14*a* is a see-through front view of a multi-unit cosmetic applicator 200 in a stored position and FIG. 14*b* is a cross-sectional view of a multi-unit cosmetic applicator 200 taken along the cross-sectional line of FIG. 14*a*.

Herein, a "stored position" is when a cosmetic unit is retracted in the housing, while an "advanced position" is when a user accessible portion, of any length, of the second cosmetic unit is extended beyond the housing so that the user can place the cosmetic agent comprised in the cosmetic unit onto their body.

Preferably, multi-unit cosmetic applicator 200 is made of plastic, metal, and/or thermoplastic elastomers, rubber, manufactured using blow molding, and assembled by snap-fit assembly. However, any other material, manufacturing, and/or assembly method may be used. Especially desired is to have certain portions of the housing made with anodized plastic materials to give an upscale and refined look.

Multi-unit cosmetic applicator 200 may include a cap 201 and a housing 202. The cap, if provided, is preferably sized to fit over a substantial portion of an upper portion of housing 202.

The housing may comprise an assembly of housing portions and defines a substantially longitudinal inner space that houses a first cosmetic unit 204*a*, a second cosmetic unit 204*b*, a dual advancement assembly that comprises a ratchet assembly 206 and a twist assembly 207 that are independently engageable of each other and to selectively place a fluidized portion of the first cosmetic unit or the second cosmetic unit relative to the other cosmetic unit in a user accessible position and/or to retract one or more cosmetic units.

For example, first cosmetic unit 204*a* may be a lip gloss or the like, which preferably is a liquid or fluidized material. Second cosmetic unit 204*b* is preferably a solid or semisolid such as a lipstick or a lip gloss. However, the second cosmetic units may also be a solid, semi-solid or waxy product such as an eye pencil, eye liner, mascara, lipstick, lip liner, lip balm, brow definer, concealer, foundation, blush, etc.

Cosmetic unit 204*b* preferably includes longitudinal channel 204*c* that permits fluidized portions of the first cosmetic unit 204*a*. Channel 204*c* extends longitudinally through the second cosmetic unit 204*b* and may have any suitable cross-sectional shape that permits fluidized portions of the cosmetic unit 204*a* to move unimpeded relative to cosmetic unit 204*b*.

Housing 202 preferably is designed to have an attractive shape and yet be ergonomically designed to fit in the user's hand. An ergonomic design may include any desired shape that is found to be suitable.

Housing 202 preferably is configured to be a have multiple annular sections and comprises a sleeve portion 202*a* that may be configured as an AG Shell and is preferably visually appealing to a user. The sleeve portion has a proximal opening 202*b* suitable for passing both fluidized portions of the first cosmetic unit 204*a* and the second cosmetic unit 204*b* through such an opening and a sleeve portion 202*a*.

Housing 202 further comprises a "stationary" housing portion 202*c* for grasping by the user while a pressure is applied to the first cosmetic unit to advance a fluidized portion and for grasping while the second cosmetic unit is advanced or retracted, an upper user portion 202*d*, i.e., second user portion 202*d*, that is also a portion of the twist assembly for selectively advancing or retracting second cosmetic unit 204*b* relative to the stationary housing portion 202*c*, and a lower user portion 202*e*, i.e., first user portion 202*e*, that is also a portion of the ratchet assembly for selectively advancing a fluidized portion of the first cosmetic unit 204*a* relative to the stationary housing portion 202*c*. Sleeve portion 202*a* may be press fit, glued, sonically welded or in some other suitable way attached to stationary housing portion 202*c* and preferably does not move relative to the stationary housing portion.

Second user portion 202*d* and stationary housing portion 202*c* are joined at a circumferential or partially circumferential joint 203*a*. Preferably, joint 203*a* is formed by overlapping one reduced circumferential portion of either the second user portion or the stationary housing portion over a circumferential portion of the other, e.g., the other of the second user portion and the stationary housing portion.

Similarly, first user portion 202*e* and second user portion 202*d* are joined at a circumferential or partially circumferential joint 203*b*. Preferably, joint 203*b* is formed by overlapping one reduced circumferential portion of either the first user portion or the second user portion over a circumferential portion of the other, e.g., the other of the first user portion and the second user portion. By employing a mating notch and depression in each joint, the user portions and/or the stationary housing portion may be quickly assembled, positive seating may be ensured, and resistance to disengagement of the joined parts may be ensured.

User portion 202*e* preferably comprises a substantially cylindrical body that defines an inner space capped by a closed end, which when cosmetic applicator 200 assembled, is distal from opening 202*b* and includes ratchet assembly 206 (shown generally), which comprises a piston 206*a* held in a retaining structure 206*b* acting via a piston surface 206*c* on cosmetic unit 204*a* held in a reservoir 206*d*.

Preferably, reservoir 206*d* is configured to take maximum advantage of available space and may comprise a shape that includes a changed transverse cross-section. As taught below, a carrier of twist assembly 207 may comprise a structure as shown with respect to carrier 157*b*. Thus, reservoir 206*d* may comprise a restricted transverse cross-section in an upper portion 206*e* to utilize the available. Reservoir 206*d* preferably includes an opening or more preferably includes a nozzle 206*f* that directs the fluidized portion forced by the piston into channel 204*c*.

When user portion 202*e* is turned, the ratchet assembly is engaged and piston 206*a* advances from a first position to a second position more proximal to opening 202*b* and causing a predetermined volume of cosmetic unit 204*a* to flow through channel 204*c* toward the tip of cosmetic unit 204*b* where a user can apply a cosmetic agent of cosmetic unit 204*a* by itself or in simultaneous combination with the cosmetic agent of cosmetic unit 204*b*. Unlike twist assembly 207, ratchet assembly 206 does not permit a reversal, e.g., the piston does not recede or retract when the ratchet assembly is turned in a direction that is opposite to the direction that advances the piston from the first to the second position.

To move the second cosmetic unit, multi-unit cosmetic applicator 200 includes twist assembly 207, which is preferably configured to be substantially identical to twist assembly 157. Twist assembly preferably comprises one or more guides 207*a*, preferably helical, disposed in the interior wall of user portion 202*d* and a carrier, substantially similar to carrier 157*b* that is rotatably advanceable or retractable relative the user portion 202*d* and the stationary housing portion 202*c* when traveling in the helical guide.

The carrier preferably includes a sleeve portion that supports the second cosmetic unit 204*b* laterally and may also include a floor that supports the bottom of second cosmetic unit 204*b*. Together the sleeve portion and the floor define the inner space that holds the second cosmetic unit. The floor preferably includes an opening that engages opening or nozzle 206*f*.

The carrier further includes a lower portion and at a distal end of the carrier, one or more tabs or pins are provided that engage guide 207*a*. When twist assembly 207 is assembled, the tabs or pins are press fitted or by some other means made to engage the guide in user portion 202*d*.

In use, the user may retrieve cosmetic applicator 200 from a storage location. Therein, the cosmetic applicator preferably is stored with cap 201 secured and, accordingly, the first cosmetic unit is in a "stored", e.g., unused position and the second cosmetic units is disposed in a stored position.

The user removes cap 201 and selects the second cosmetic units to advance. For example, first cosmetic unit 204*a* may be a lip gloss and may be fluidized by pressure. However, to apply it, the second cosmetic unit, which may be a lipstick or conditioner, must first be advanced.

Thus, the user grasps stationary housing portion 202*c* and user portion 202*d* and twists the user portion 202*d* while holding the stationary housing portion. Twisting housing portion 202*d* engages twist assembly 207 but not ratchet assembly 206. In fact, the user portion 202*e* does not twist or turn with user portion 202*d* due to construction of joint 203*b*.

Twisting housing portion 202*d* engages twist assembly 207 via pins or tabs of the carrier. The carrier moves relative to the user portion 202*d*. The tip of cosmetic unit 204*b* advances through opening 202*b* into a user-accessible position. If the user accidentally continues turning the user portion 202*d*, pins or tabs reach a proximal end of the guide and the carrier will cease to advance. Once cosmetic unit 204*b* is in the user accessible position, the user can apply the agent of cosmetic unit 204*b* and/or the agent of cosmetic unit 204*a*.

To apply the agent of cosmetic unit 204, the user grasps stationary housing portion 202*c* and user portion 202*e* and twists the user portion 202*e* while holding the stationary housing portion. Twisting housing portion 202*e* engages ratchet assembly 206 but not twist assembly 207. In fact, the user portion 202*d* does not twist or turn with user portion 202*e* due to construction of joint 203*b*.

Engaging ratchet assembly 206 causes piston 206 to advance in reservoir 206*d* to force out a predetermined volume of a fluidized portion of cosmetic unit 204*a*. The fluidized portion leaves the reservoir through opening or nozzle 206*f* and advances through pressure of additional fluidized material through channel 204*c* to the tip of cosmetic unit 204*b* into a user accessible position. The user can then apply the cosmetic agent of cosmetic unit 204*a*.

The user then may wish to store cosmetic applicator. In preparation, the user preferably retracts the second cosmetic unit by turning user portion 202*d* relative to stationary housing portion 202*c* in the opposite direction when advancing cosmetic unit 204*b*. Twisting housing portion 2022*d* once again engages twist assembly 207 via protrusions and the carrier moves relative to housing portion 202*d*. The tip of the cosmetic unit retracts through opening 202*b* into a stored position. If the user accidentally continues turning the user portion 202*d*, pins or tabs of the carrier reach the distal end of the guide and the carrier will cease to retract.

Since the ratchet assembly does not require retraction of cosmetic unit 204*a*, the user can close the cosmetic applicator by securing cap 151 once cosmetic unit 204*b* is in the stored position.

As illustrated with respect to the embodiment of cosmetic applicator 200, a rotational ratchet assembly is disclosed. However, it should be appreciated that a ratchet assembly 206 may be constructed to include a push button assembly that advances a piston in a reservoir that holds a cosmetic unit, such as cosmetic unit 204*a*. The push-button ratchet assembly may be disposed cooperatively with a twist assembly such as assembly 207, e.g., twist assembly 157.

Figures 15A, 15B, 15C, 15D:
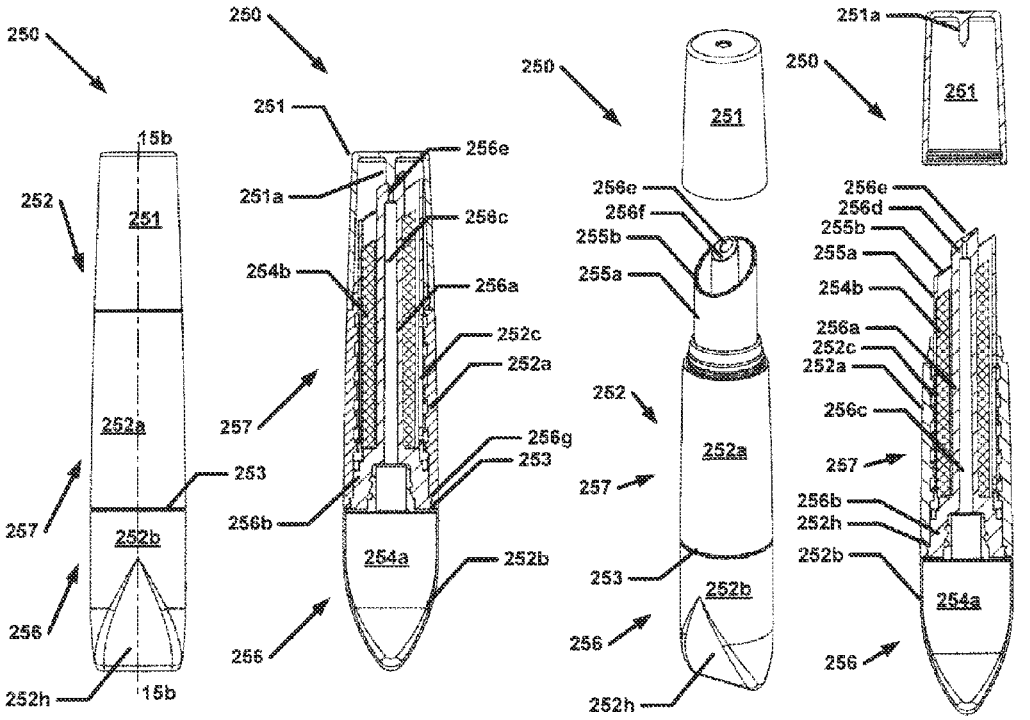
FIG. 15*a*-15*e* are, respectively, a front view of a multi-unit cosmetic applicator in a stored and closed position, a cross-sectional view of a multi-unit cosmetic applicator taken along the cross-sectional line of FIG. 15*a*, a front view of a multi-unit cosmetic applicator in a stored but open position, a cross-sectional view of a multi-unit cosmetic applicator taken along the cross-sectional line of FIG. 15, and an exploded view of a multi-unit cosmetic applicator.
Figure 15E:
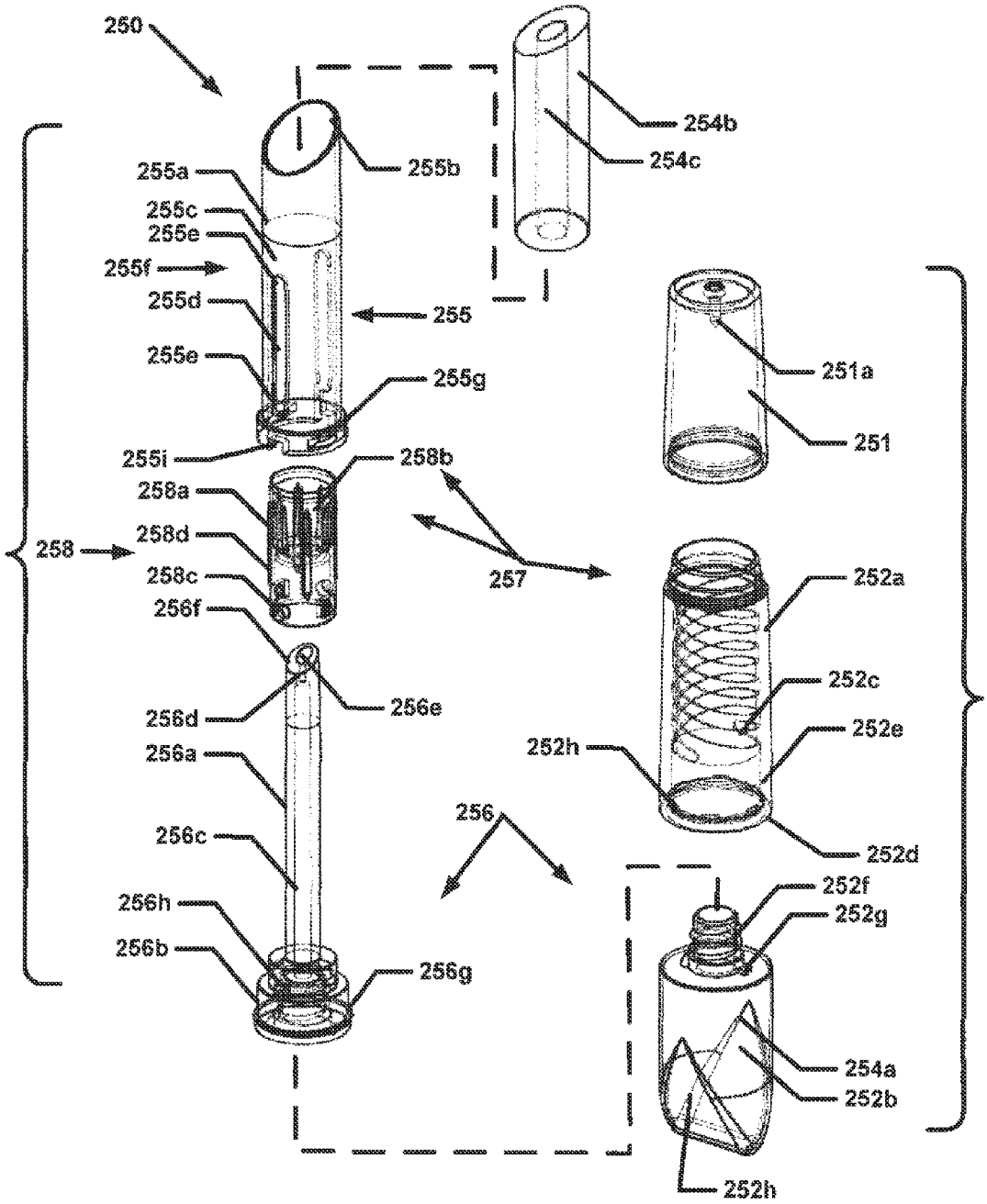

In accordance with one or more embodiments of the present invention, FIG. 15*a*-15*e* are, respectively, a front view of a multi-unit cosmetic applicator 250 in a stored and closed position, a cross-sectional view of a multi-unit cosmetic applicator 250 taken along the cross-sectional line of FIG. 15*a*, a front view of a multi-unit cosmetic applicator 250 in a stored but open position, a cross-sectional view of a multi-unit cosmetic applicator 250 taken along the cross-sectional line of FIG. 15, and an exploded view of multi-unit cosmetic applicator 250.

Herein, a "stored position" is when a cosmetic unit is retracted in the housing, while an "advanced position" is when a user accessible portion, of any length, of the second cosmetic unit is extended beyond the housing so that the user can place the cosmetic agent comprised in the cosmetic unit onto their body.

Preferably, multi-unit cosmetic applicator 250 is made of plastic, metal, and/or thermoplastic elastomers, rubber, manufactured using blow molding, and assembled by snap-fit assembly. However, any other material, manufacturing, and/or assembly method may be used. Especially desired is to have certain portions of the housing made with anodized plastic materials to give an upscale and refined look.

Multi-unit cosmetic applicator 250 may include a cap 251 and a housing 252. The cap, if provided, is preferably sized to fit over a substantial portion of an upper portion of housing 252. Cap 251 includes a tapered plug 251*a* that fits into a portion of a channel that delivers a portion of the first cosmetic unit.

The housing may comprise an assembly of housing portions and defines a substantially longitudinal inner space that houses a first cosmetic unit 254*a*, a second cosmetic unit 254*b*, a dual advancement assembly that comprises a squeeze assembly 256 and a twist assembly 257 that are independently engageable of each other and to selectively place a fluidized portion of the first cosmetic unit or the second cosmetic unit relative to the other cosmetic unit in a user accessible position and/or to retract one or more cosmetic units.

For example, first cosmetic unit 254*a* may be a lip gloss or the like, which preferably is a liquid or fluidized material. Second cosmetic unit 254*b* is preferably a solid or semisolid such as a lipstick or a lip gloss. However, the second cosmetic units may also be a solid, semi-solid or waxy product such as an eye pencil, eye liner, mascara, lipstick, lip liner, lip balm, brow definer, concealer, foundation, blush, etc.

Cosmetic unit 254*b* preferably includes longitudinal channel 254*c* that permits fluidized portions of the first cosmetic unit 254*a*. Channel 254*c* extends longitudinally through the second cosmetic unit 254*b* and may have any suitable cross-sectional shape that permits cosmetic unit 254*b* to be assembled around a delivery tube of the squeeze assembly.

Housing 252 preferably is designed to have an attractive shape and yet be ergonomically designed to fit in the user's hand. An ergonomic design may include any desired shape that is found to be suitable.

Housing 252 preferably is configured to comprise a first housing portion 252*a*, e.g., user portion 252*a*, and a second housing portion 252*b*, preferably configured as a squeezable tottle tube, which may be snap fit or press fit together during assembly. Housing portion 252*a* includes one or more guides 252*c*, preferably helical, in which a carrier is movable to advance or retract cosmetic unit 254*b*. The guide is preferably spaced from the lower edge 252*d* by a space 252*e* to permit a connector to be received in the housing portion.

Squeeze assembly 256 comprises user portion 252*b*, tube 256*a*, and connector 256*b*, which together allow a fluidized portion of cosmetic unit 254*a* to travel from the user portion 252*b* to a tip end of tube 256*a* via at least partially a passageway 256*c*. User portion 252*b* acts as a reservoir for cosmetic unit 252*a* and, preferably, comprises a material that permits the user portion to be squeezed. Thereto, user portion 252*b*, may have any suitable shape and preferably includes a suitable user-friendly portion 252*h* that permit the user to have a suitable pressure application area.

User portion 252*b* includes an attaching mechanism 252*f* that may be any suitable attaching mechanism to attach to connector, but preferably is a screw thread that mates with a receiving screw head in the connector and includes one or more locking or orienting tabs 252*g*. The screw mechanism permits easy replacement of user portion 252*b* when the cosmetic agent 254*a* has been exhausted by the user or has been rendered unusable or undesirable for any reason.

The passageway may comprise a reduced area 256*d* before connecting to opening 256*e*, which may be located on a user friendly angled surface 256*f*. The reduced area of the passageway serves to maintain pressure and/or prevent undue amounts of air to be able reach the cosmetic unit.

User portion 252*a* and connector 256*b* preferably form a circumferential or partially circumferential joint 253. Preferably, joint 253 is formed by having a mated depression and notch that permit rotational movement of either user portion 252*a* or connector 256*b* relative to the other. For example, connector 256*b* may comprise a circumferential or partially circumferential notch 256*g* and a corresponding depression 252*h* in user portion 252*a*. By employing a mating notch and depression in the joint, the user portions may be quickly assembled, positive seating may be ensured, and resistance to disengagement of the joined parts may be ensured.

Twist assembly 257 comprises a sleeve 255 that is sized to jacket a carrier 258, the carrier, and user portion 252*a*. The sleeve includes an upper sleeve portion 255*a* that may be configured as an AG Shell and that is preferably visually appealing to a user. Upper sleeve portion 255*a* includes an opening 255*b* suitable for passing both the first cosmetic unit 254*a* and the second cosmetic unit 254*b* through such an opening.

When a user squeezes user portion 252*b*, an amount of cosmetic agent is expelled from the user portion and via pressure travels through the connector and passageway to surface 256*f*, where a user can apply the cosmetic agent.

Sleeve 255 includes a lower sleeve portion 255*c* in which one or more longitudinal guides 255*d* are disposed. Each longitudinal guide preferably includes one or more restrictions 255*e* disposed at each end of guide 255*d* that narrow the guides and form an initial locking structure 255*f*.

Sleeve 255 comprises a collar 255*g* that includes openings 255*i* that seat onto protrusions 256*i* on connector 256*b* such that the sleeve and connector 256*b*, e.g., user portion 252*b*, are rotatably joined permitting a carrier that holds the second cosmetic unit to advance or retract relative to the user portion 252*b* when user portion 252 is twisted.

A carrier 258 is received in sleeve 255 such that the carrier is displace is configured to comprise an elongate, cylindrical structure having an upper portion 258*a* provided with one or more guides 258*b* disposed on an internal wall that engage cosmetic unit 254*b* by friction. One or more pins or tabs 258*c* are provided on a lower portion 258*d* and are sufficiently sized to engage guide 255*e* and guide 252*c*.

In use, the user may retrieve cosmetic applicator 250 from a storage location and, accordingly, the second cosmetic unit is disposed in a stored position. Therein, the cosmetic applicator preferably is stored with cap 251 secured and plug 251*a* secured in opening 256*e*.

For example, cosmetic unit 254*b* may be a lip stick, the user may select it first to fill in the lips. The user advances retracted cosmetic unit 254*b*. The user holds user portion 252*b* and twists user portion 252*a* causing carrier 258 to move in guides 255*e* and 252*c* until they reach the proximal end of guides 255*e* at which time the carrier pins overcomes the locking force of locking structure 255*f*. The carrier pins are initially disposed in a locking position in sleeve guide 255*d*. Thus, the user initially must apply a slightly greater force, which the user can interpret as a confirmation that the internal mechanisms of the cosmetic applicator are working in response to the user. By turning user portion 252*a* in the reverse, cosmetic unit 254*b* may be retracted. In the case of the reverse action of retracting cosmetic unit 254*b*, the locking action can serve as confirmation of secure positioning.

The user may then also apply the first cosmetic unit, by squeezing user portion 252*b* causing a fluidized portion of the first cosmetic unit to exit via opening 256*e*.

It should be appreciated that the above disclosure may be adapted by one skilled in the art to arrive at multiple other embodiments and such embodiments are specifically intended to be included in the present invention. For example, a multiunit cosmetic applicator may comprise one or more slider assemblies in combination with one or more twist assemblies and/or ratchet assemblies. Similarly, one or more ratchet, push-button, and squeeze assemblies may be combined in one or more ways in a multi-unit cosmetic applicator.

The following patents and patent publications are hereby incorporated by reference for all purposes:

US Patent Publication 2005/0100388

U.S. Pat. No. 6,543,458; U.S. Pat. No. 6,497,524.

What is claimed is:

1. A multi-unit cosmetic applicator comprising:

a housing, a first cosmetic unit comprising a first cosmetic agent housed in the housing, a second cosmetic unit comprising a second cosmetic agent housed in the housing, a single distal opening in the housing, wherein each cosmetic unit has a means for independently moving the cosmetic agent relative to the other cosmetic agent from a stored position to an advanced position through the single distal opening in the housing where the respective cosmetic agent is placed in a user-accessible position; and wherein one means comprises a twist assembly and another means comprises a ratchet assembly.

2. The multi-unit cosmetic applicator of claim 1, wherein the ratchet assembly comprises a piston and a reservoir for storing the first cosmetic unit.

3. The multi-unit cosmetic applicator of claim 2, wherein the piston forces a portion of the first cosmetic unit from the reservoir.

4. The multi-unit cosmetic applicator of claim 3, wherein the second cosmetic unit comprises a channel for delivering the portion of the first cosmetic unit forced from the reservoir into the user-accessible position.

5. The multi-unit cosmetic applicator of claim 1, wherein the cosmetic unit associated with the ratchet assembly comprises one of a gel and a liquid structure.

6. A method of using multi-unit cosmetic applicator of claim 1, the method comprising the steps of:

initiating a first means for placing one of the first and second cosmetic agents in the user accessible position; and initiating a second means for placing the other of the first and second cosmetic agents in the user accessible position, wherein the step of initiating one of the first and second means comprises ratcheting a ratchet assembly.

* * * * *